US010752009B2

(12) United States Patent
Kudo et al.

(10) Patent No.: US 10,752,009 B2
(45) Date of Patent: Aug. 25, 2020

(54) LIQUID TANK AND LIQUID EJECTION DEVICE

(71) Applicant: SEIKO EPSON CORPORATION, Tokyo (JP)

(72) Inventors: Shoma Kudo, Shiojiri (JP); Hideki Okumura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/262,356

(22) Filed: Jan. 30, 2019

(65) Prior Publication Data

US 2019/0232669 A1 Aug. 1, 2019

(30) Foreign Application Priority Data

Jan. 31, 2018 (JP) ..... 2018-014568

(51) Int. Cl.
*B41J 2/175* (2006.01)
*B41J 29/13* (2006.01)

(52) U.S. Cl.
CPC ..... *B41J 2/17553* (2013.01); *B41J 2/175* (2013.01); *B41J 2/17509* (2013.01); *B41J 2/17513* (2013.01); *B41J 2/17566* (2013.01); *B41J 29/13* (2013.01); *B41J 2002/17579* (2013.01)

(58) Field of Classification Search
CPC .... B41J 2/17513; B41J 2/175; B41J 2/17503; B41J 2/17509; B41J 2/17566; B41J 2/145; B41J 2/17506; B41J 2002/17579
See application file for complete search history.

(56) References Cited

U.S. PATENT DOCUMENTS 6,378,971 B1 * 4/2002 Tamura ..... B41J 2/175 347/7
2014/0043408 A1 * 2/2014 Kudo ..... B41J 2/17513 347/86
2014/0063148 A1 * 3/2014 Iwamuro ..... B41J 2/1752 347/86
2015/0049147 A1 * 2/2015 Nakano ..... B41J 2/17506 347/87
2015/0284170 A1 * 10/2015 Igarashi ..... B41J 2/17513 222/394
2016/0263905 A1 9/2016 Kimura et al.
2018/0111382 A1 * 4/2018 Kawagoe ..... B41J 2/1752

FOREIGN PATENT DOCUMENTS

JP 2016-168835 A 9/2016

* cited by examiner

*Primary Examiner* — John Zimmermann
(74) *Attorney, Agent, or Firm* — Foley & Lardner LLP

(57) ABSTRACT

Provided is a liquid tank that can reduce the remaining amount of liquid even if a use state of the liquid tank is in an inclined state. The liquid tank includes an external wall, a liquid discharge port, and a first protruding portion and a second protruding portion that are provided inside the liquid tank and respectively protrude from a third side wall. The height of the second protruding portion from a bottom wall in a use state is higher than the height of the first protruding portion from the bottom wall. The first protruding portion has, at an upper portion thereof, a first inclined portion that is inclined to the upper part in the first direction, and the second protruding portion has, at an upper portion thereof, a second inclined portion that is inclined to the upper part in the second direction.

18 Claims, 17 Drawing Sheets

LIQUID TANK AND LIQUID EJECTION DEVICE

BACKGROUND

1. Technical Field

The present invention relates to a liquid tank and a liquid ejection device.

2. Related Art

Heretofore, a tank has been disclosed that can reduce the remaining amount of liquid even if a printer is used in a state inclined in one direction (see JP-A-2016-168835, for example).

JP-A-2016-168835 is an example of related art.

However, in the above-mentioned printer, there is a problem in that, when the printer is inclined in a direction opposite to the one direction, a lot of liquid remains in the tank.

SUMMARY

An advantage of some aspects of the invention is to provide a liquid tank and a liquid ejection device that can reduce the amount of remaining liquid inside even if the liquid ejection device is used in a state inclined not only in one direction, but also in another direction.

The invention can be implemented as the following modes or application examples.

Application Example 1

A liquid tank according to a present application is a liquid tank that can supply liquid to a liquid ejection unit of a liquid ejection device, the tank includes: an exterior wall that constitutes a liquid containing chamber configured to contain the liquid and includes an upper wall located in an upper part in the vertical direction in a use state, a bottom wall opposed to the upper wall, a first side wall intersecting with each of the upper wall and the bottom wall and having a viewing portion through which the liquid amount of the liquid can be visually recognized, a second side wall opposed to the first side wall, and a third side wall intersecting with each of the upper wall, the bottom wall, the first side wall, and the second side wall; a liquid discharge port configured to discharge the liquid to the outside of the liquid tank; and a first protruding portion and a second protruding portion that are provided inside the liquid tank and respectively protrude from the third side wall, wherein letting a direction from the first side wall to the second side wall be a first direction, and a direction opposite to the first direction be a second direction, the height of the second protruding portion from the bottom wall in a use state is higher than the height of the first protruding portion from the bottom wall, the first protruding portion includes, at an upper portion thereof, a first inclined portion that is inclined to the upper part in the first direction, and the second protruding portion includes, at an upper portion thereof, a second inclined portion that is inclined to the upper part in the second direction.

With this configuration, the first protruding portion and the second protruding portion are formed in which the first inclined portion and the second inclined portion are mutually inclined in different directions. Accordingly, even if the liquid ejection device is used in a state inclined to either the first direction side or the second direction side, it is possible to reduce the amount of liquid corresponding to the volume of the first protruding portion and the second protruding portion, and thus the remaining liquid amount in the liquid tank can be reduced.

Application Example 2

The liquid tank according to the above application includes an electrode member, at least one end of which is located in the liquid tank and configured to detect the liquid, wherein a first gap is provided between the first protruding portion and the second side wall, and the electrode member is arranged in the first gap such that the one end is located above the bottom wall when viewed in a plan view toward the third side wall.

With this configuration, the electrode member is arranged in the first gap between the first protruding portion and the second side wall. In this manner, a certain distance is secured between the electrode member and the first protruding portion, and the generation of a meniscus between the electrode member and the first protruding portion can be prevented. Accordingly, a decrease in detection accuracy can be suppressed.

Also, the electrode member is arranged on the second side wall side opposite to the first side wall that has a viewing portion. Therefore, the electrode member can be made less visible through the viewing portion, and thus it is possible to enhance designability and make it easy to visually recognize the liquid amount.

Application Example 3

In the liquid tank according to the above application, a second gap is provided between the second protruding portion and the second side wall, and the electrode member is arranged such that the one end is located above the bottom wall and in the second gap when viewed in a plan view toward the third side wall.

With this configuration, the electrode member is arranged in the second gap between the second protruding portion and the second side wall. In this manner, a certain distance is secured between the electrode member and the first protruding portion, and the generation of a meniscus between the electrode member and the first protruding portion can be prevented. Accordingly, a decrease in detection accuracy can be suppressed.

Also, the electrode member is arranged on the second side wall side opposite to the first side wall that has the viewing portion. Therefore, the electrode member can be made less visible through the viewing portion, and thus it is possible to enhance designability and make it easy to visually recognize the liquid amount.

Application Example 4

In the liquid tank according to the above application, letting a direction orthogonal to the first direction in the horizontal direction be a third direction, the length of the first protruding portion in the third direction is shorter than the length of the second side wall in the third direction.

With this configuration, the length of the first protruding portion in the third direction is shorter than the length of the second side wall in the third direction, and thus, in the third direction, the portion by which the first protruding portion is shorter than the second side wall serves as a flow passage. Accordingly, the liquid remaining at the bottom portion of the liquid tank can flow through the flow passage, and thus the remaining amount of the liquid can be reduced.

Application Example 5

In the liquid tank according to the above application, the length of the second protruding portion in the third direction is shorter than the length of the first protruding portion in the third direction.

With this configuration, for example, it is possible to accommodate an amount equivalent to the volume of the ink contained in a container for replenishing the liquid to the liquid tank.

Application Example 6

In the liquid tank according to the above application, a gap is provided between the second protruding portion and the first side wall.

With this configuration, the second protruding portion can be made less visible through the viewing portion due to the gap between the second protruding portion and the first side wall, and thus it is possible to enhance designability and make it easy to visually recognize the liquid amount in the liquid tank.

Application Example 7

In the liquid tank according to the above application, a gap is provided between the first protruding portion and the first side wall.

With this configuration, the first protruding portion can be made less visible from the viewing portion due to the gap between the first protruding portion and the first side wall, and thus it is possible to enhance designability and make it easy to visually recognize the liquid amount in the liquid tank.

Application Example 8

In the liquid tank according to the above application, the first side wall is arranged at a position farther from the liquid ejection unit than the second side wall is, and the liquid discharge port is provided at the bottom wall and is arranged at a position closer to the first side wall than to the second side wall.

With this configuration, for example, even if the liquid ejection device falls over in a state in which the first side wall side is higher than the second side wall side, the position of the liquid discharge port can be made higher than the liquid surface of the liquid in the liquid tank, and thus the likelihood that liquid will flow out from the liquid ejection unit due to the load of the liquid can be reduced.

Application Example 9

The liquid ejection device according to the present application includes the above-mentioned liquid tank and the liquid ejection unit.

With this configuration, even if the liquid ejection device is used in an inclined state, the liquid is less likely to remain in the liquid tank, and thus convenience can be enhanced.

DESCRIPTION OF EXEMPLARY EMBODIMENTS

Hereinafter, embodiments of the invention will be described with reference to the drawings.

First, the configuration of a liquid ejection device will be described. Note that, in the present embodiment, the configuration of a printer as a liquid ejection device will be described.

Figure 1:
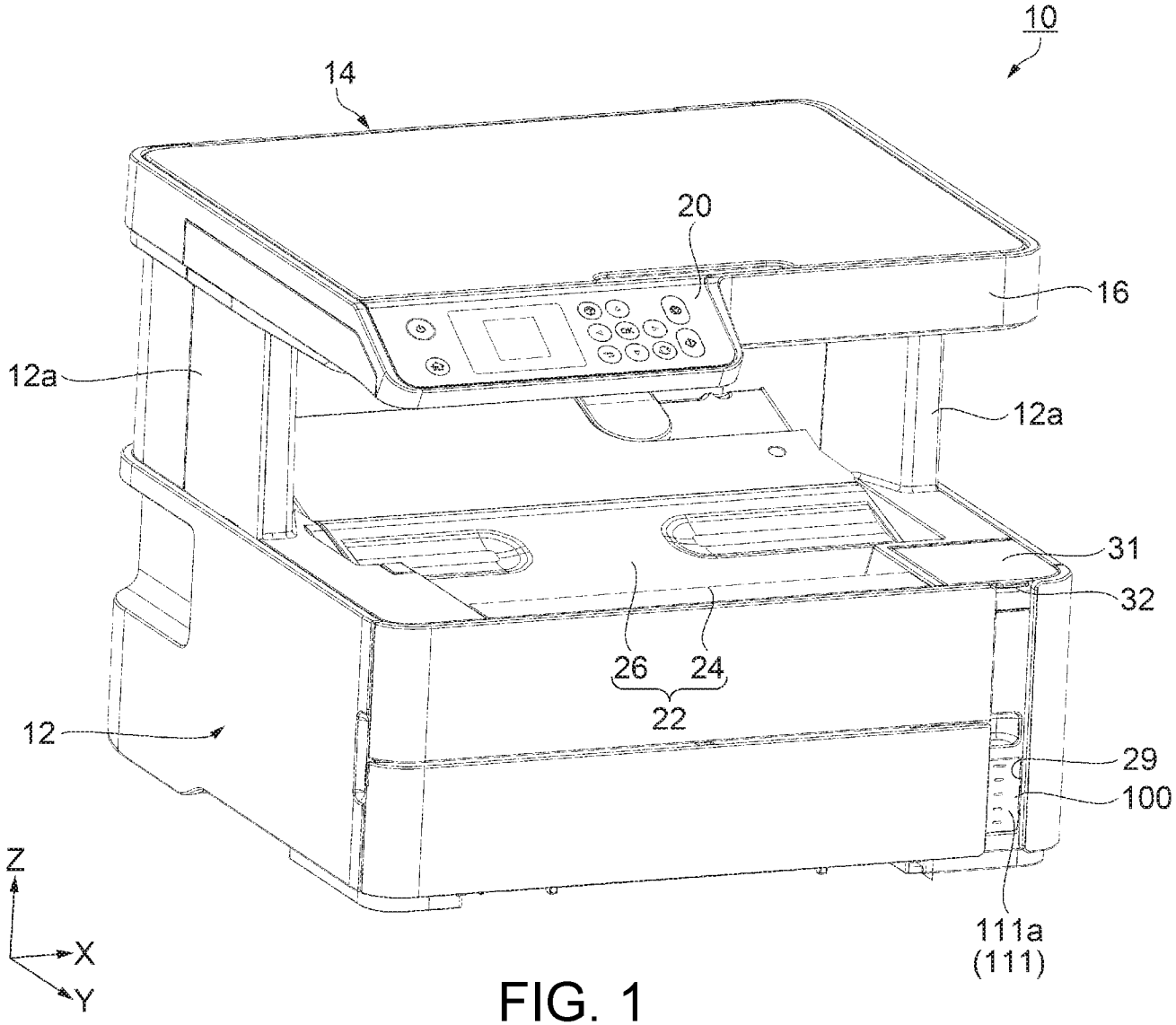
FIG. 1 is a perspective view showing the configuration of a printer (a liquid ejection device).
Figure 2:
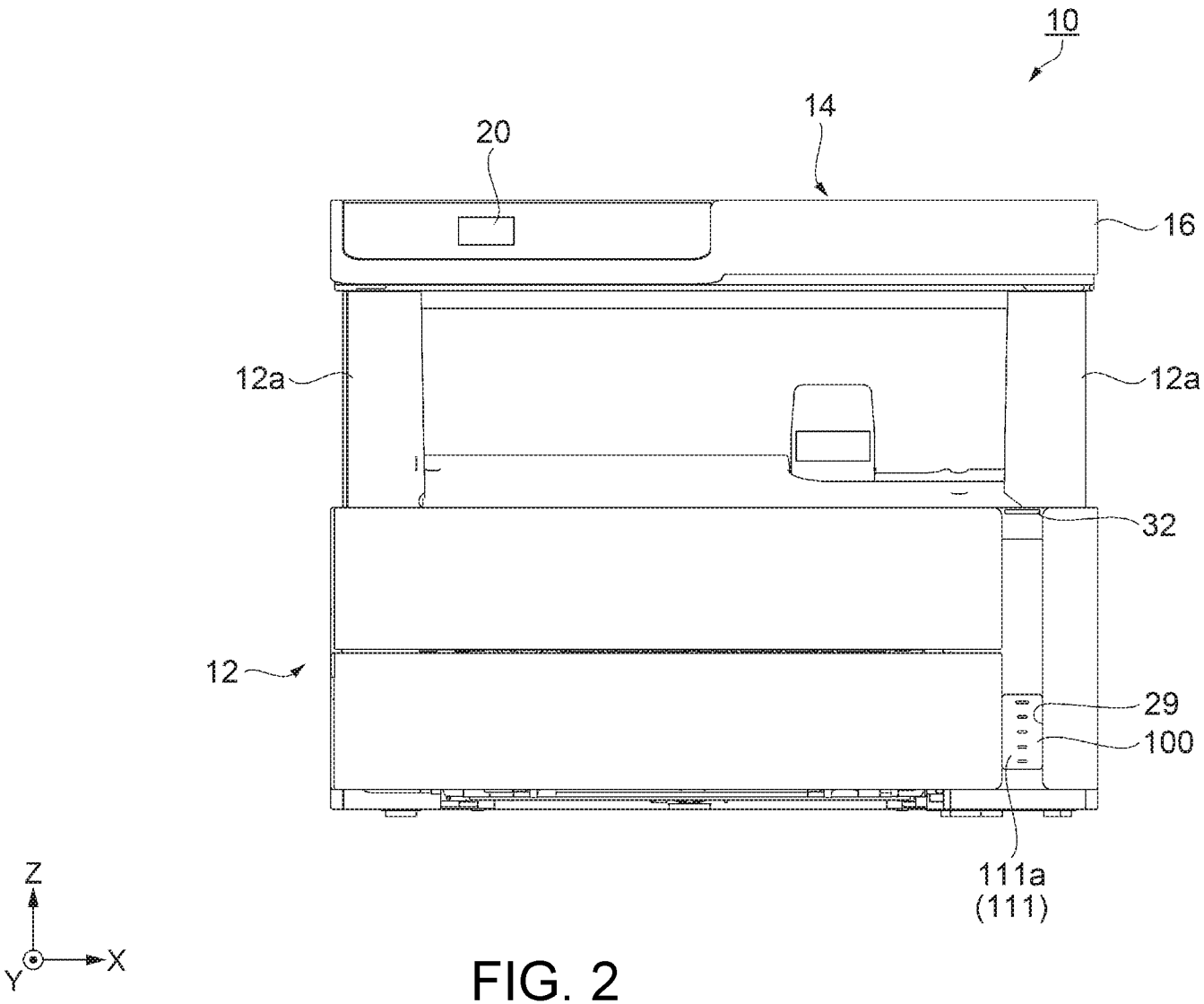
FIG. 2 is an elevation view showing the configuration of the printer (the liquid ejection device).

FIG. 1 is a perspective view showing the configuration of the liquid ejection device, and FIG. 2 is an elevation view showing the configuration of the liquid ejection device.

As shown in FIGS. 1 and 2, a printer 10 is constituted as an ink jet printer as one example of the liquid ejection device. In FIG. 1, X, Y, and Z axes are shown, which are coordinate axes orthogonal to each other. The X-Y plane is parallel to the horizontal plane. The +Z direction refers to the vertically upward direction, and the −Z direction refers to the vertically downward direction. In the embodiment, the +Z and −Z directions are also collectively referred to as the Z axis direction. Similarly, the +X and −X directions are also collectively referred to as the X axis direction, and the +Y and −Y directions are also collectively referred to as the Y axis direction. It should be noted that the X, Y, and Z axes directions in FIG. 2 and the subsequent drawings indicate the same directions as those indicated by the X, Y, and Z axes directions in FIG. 1.

Note that, the use state of the printer 10 according to the present embodiment is a state of the printer installed on a horizontal plane, and in this embodiment, the X-Y plane parallel to the X axis and the Y axis is a horizontal plane.

The printer 10 according to the present embodiment is constituted as a multi-function printer that includes a casing 12 and a scanner unit 14. In the both end portions in the X-direction of the casing 12, support portions 12*a* that protrude in the +Z direction are formed. The scanner unit 14 is arranged above the casing 12, and is supported by the support portions 12*a*.

The scanner unit 14 includes a scanner body 16. The end portion in the +Y direction of the scanner body 16 is provided with an operation unit 20. The operation unit 20 includes multiple operation buttons and a display panel. In the present embodiment, the operation unit 20 is configured to be capable of instructing the recording operation in the printer 10 and the image reading operation in the scanner unit 14.

A medium receiving tray 22 is provided in the upper portion of the casing 12. In the present embodiment, the medium receiving tray 22 includes a first tray 24 and a second tray 26. In the present embodiment, the first tray 24 is fixed to the casing 12. On the other hand, the second tray 26 is pivotably attached to the casing 12. In the present embodiment, the medium receiving tray 22 is configured to receive a medium that is discharged from inside the casing 12, in an inclined attitude. Specifically, the medium receiving tray 22 is configured to have an inclined surface in the sloping upward (in the +Z axis direction) toward the −Y direction that is the medium discharge direction.

In the printer 10, a tank 100 (liquid tank) that can accommodate ink as liquid is accommodated in the casing 12. In the present embodiment, the tank 100 is accommodated at the end portion in the +X direction of the casing 12. Also, in a portion of the tank 100, a viewing portion 111*a* (first side wall 111) through which the ink amount (liquid amount) of the ink accommodated in the tank 100 can be visually recognized is formed. Then, an opening portion 29 is formed in the casing 12, through which the viewing portion 111*a* of the tank 100 that is accommodated in the casing 12 can be visually confirmed. With this configuration, a user can recognize the remaining amount of ink in the tank 100 from the outside of the printer 10.

Next, the ink supply mode to the tank 100 in the printer 10 will be described.

Figure 3A:
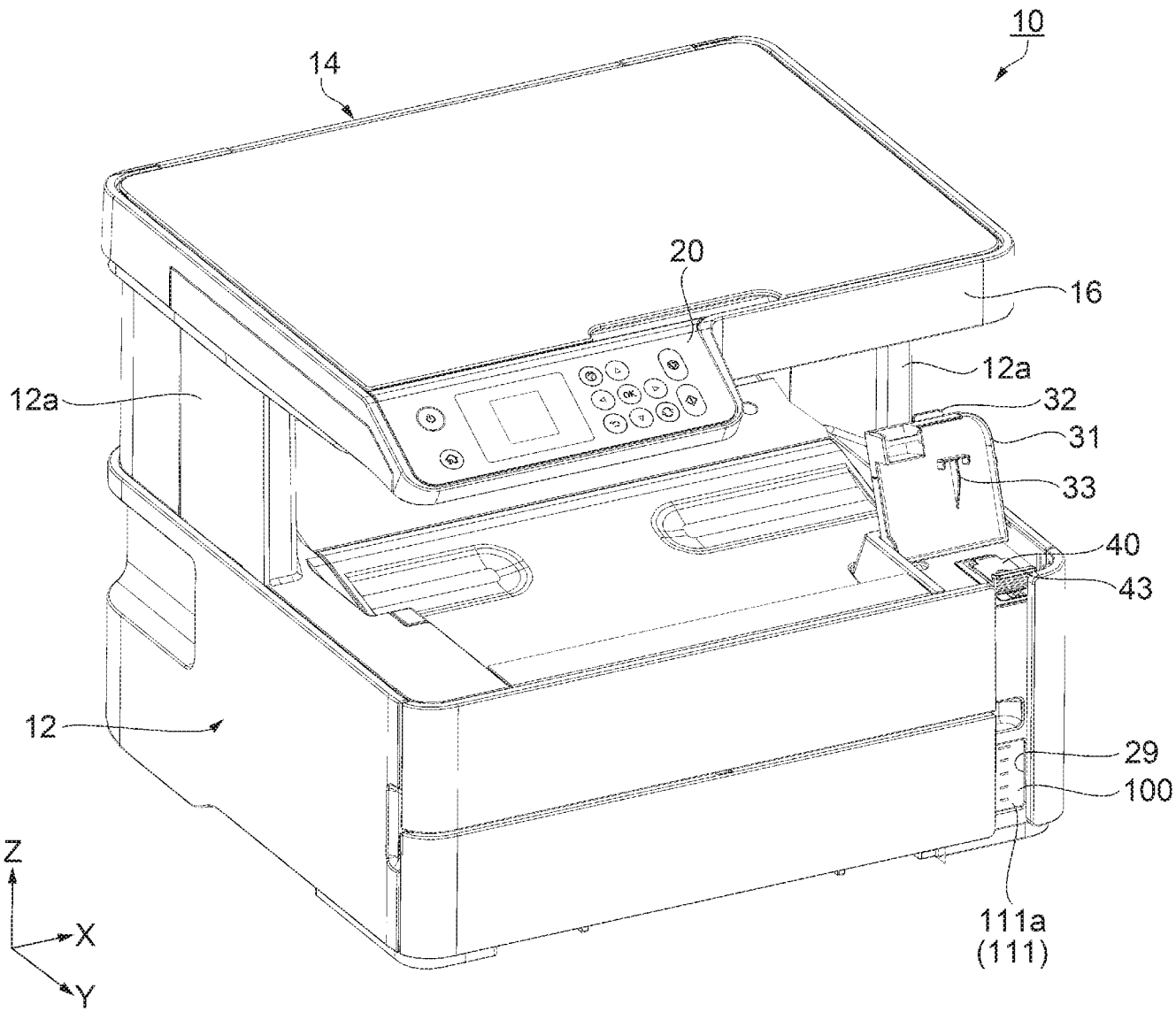
FIG. 3A is a perspective view showing the configuration of the printer (the liquid ejection device).
Figure 3B:
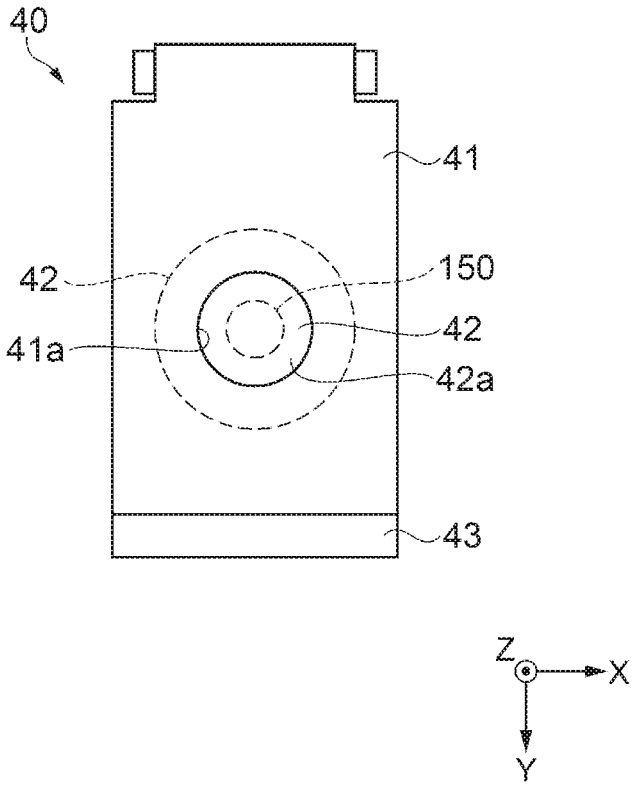
FIG. 3B is a plan view showing the partial configuration of the printer (the liquid ejection device).
Figure 4:
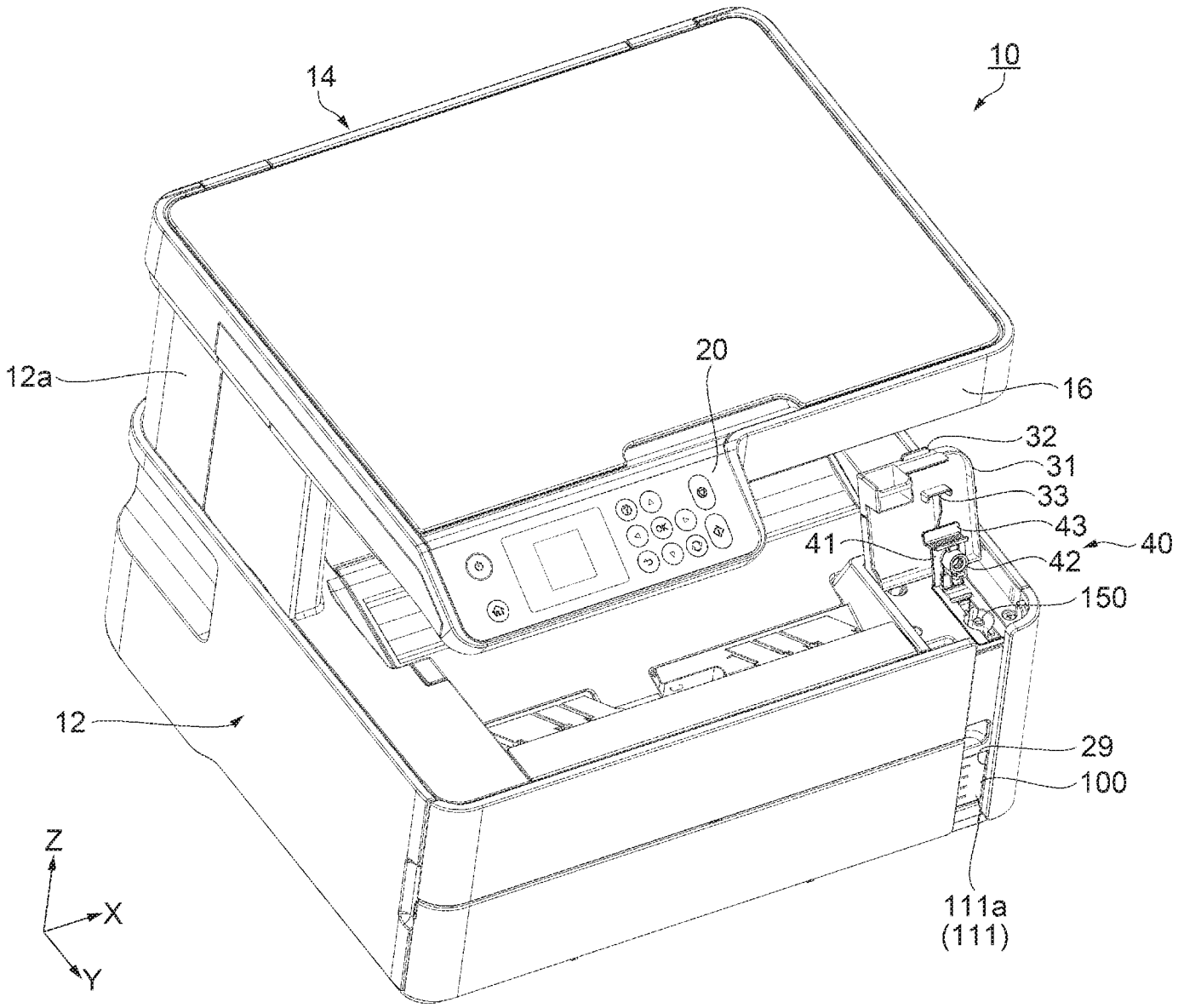
FIG. 4 is a perspective view showing the configuration of the printer (the liquid ejection device).
Figure 5:
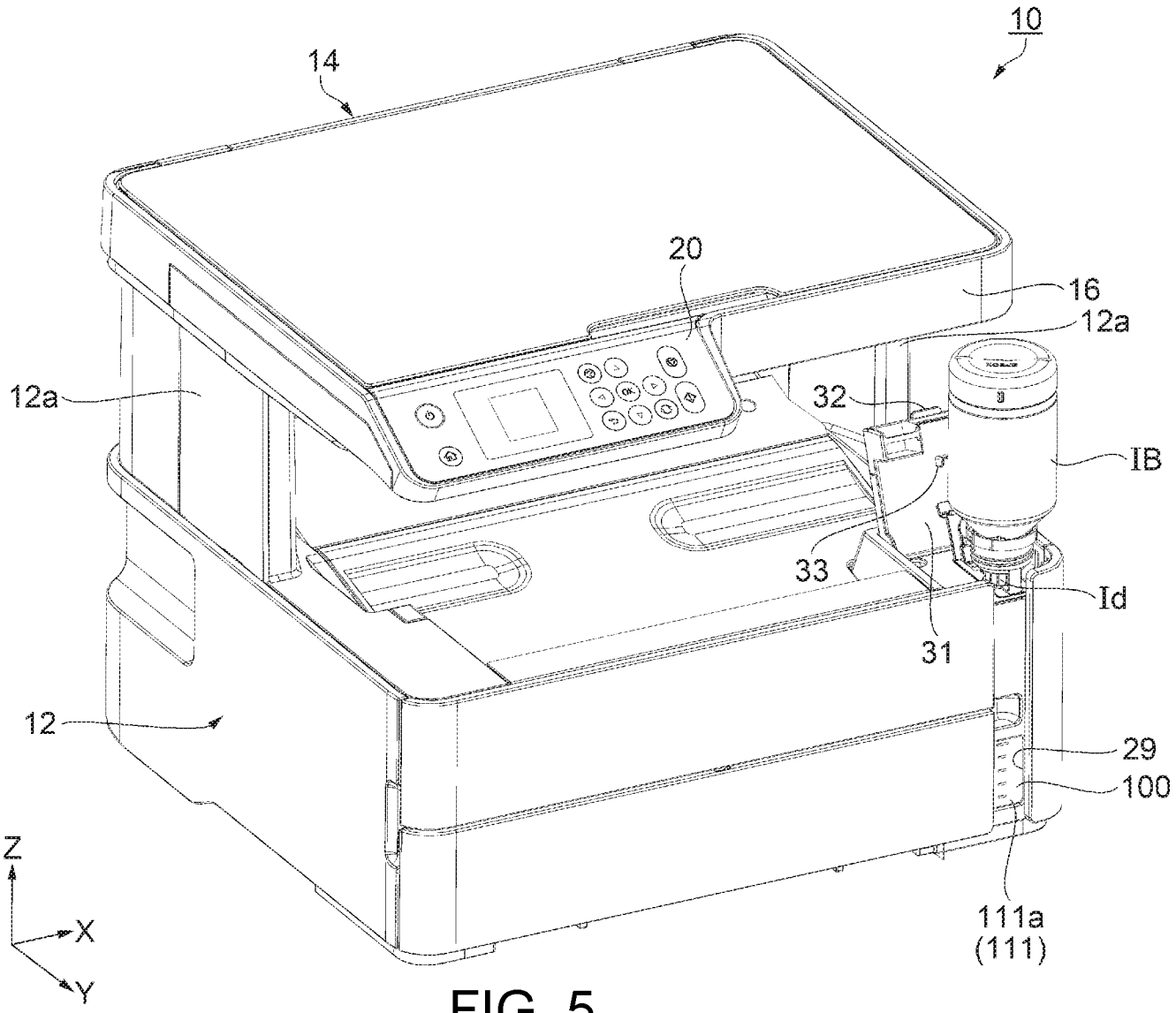
FIG. 5 is a perspective view showing the configuration of the printer (the liquid ejection device).

FIGS. 3A, 4, and 5 are perspective views showing the configuration of the liquid ejection device, and are views showing the ink supply mode to the tank 100 in the printer 10. Note that FIG. 3B is a plan view showing a partial configuration of the liquid ejection device.

As shown in FIG. 1, a plate-shaped cover 31 that covers the upper portion of the tank 100 is provided above the tank 100. FIG. 1 shows the closed state of the cover 31.

A tab 32 is provided at the end portion in the +Y direction of the cover 31, and the cover 31 can be shifted to the open state via a shaft portion (not shown) by a user using his or her fingers to pull up the tab 32 and lift the tab 32 upward. FIG. 3 shows the open state of the cover 31. Also, the cover 31 can be shifted from the open state to the closed by pulling and moving down the tab 32 with fingers. Note that, the cover 31 may be configured to be opened and closed by a sliding manner.

As shown in FIG. 3A, when the cover 31 is shifted to the open state, a plug member 40 for closing a liquid inlet 150 (see FIG. 7) of the tank 100 becomes visible.

FIG. 3B is a plan view showing the plug member 40. As shown in FIG. 3B, the plug member 40 has an elastically deformable plug main body 42 that covers the liquid inlet 150 and a holding member 41 that holds the plug main body 42. The holding member 41 has an elongated shape longer in one direction (the Y direction).

Note that, an opening 41*a* for inserting and holding the plug main body 42 is formed in the holding member 41, and a part of the plug main body 42 (a top portion 42*a*) can be visually recognized from the opening 41*a*.

Also, as shown in FIGS. 3A and 3B, a gripping portion 43 that a user can grip is provided at the end portion in the +Y direction of the holding member 41.

Then, the holding member 41 can be opened and closed by a shaft portion (not shown) provided at the end portion in the −Y direction of the holding member 41.

Also, as shown in FIG. 3A, a protruding portion 33 is formed on the surface side of the cover 31 facing the plug member 40. The protruding portion 33 is formed such that the top portion of the protruding portion 33 abuts against the holding member 41 of the plug member 40 when the cover portion 31 is closed. In other words, the holding member 41 is pressed against the protruding portion 33 by the top portion of the protruding portion 33 abutting against the holding member 41 of the plug member 40. Then, the plug main body 42 is pressed toward the liquid inlet 150 side by the holding member 41 being pressed against by the protruding portion 33. In this manner, the liquid inlet 150 can be reliably covered with the plug member 40.

It should be noted that the invention is not limited to the above structure. For example, a configuration is possible in which the cover 31 has a flat surface, a protruding portion is formed on a side of the holding member 41 of the plug member 40, and the cover and the protruding portion are in contact with each other when the cover portion 31 is closed.

By lifting up the gripping portion 43 of the plug member 40, the plug main body 42 is separated from the liquid inlet 150 of the tank 100. FIG. 4 shows the open state of the plug member 40. When the plug member 40 is opened, the liquid inlet 150 of the tank 100 becomes visible.

As shown in FIG. 5, by connecting an introduction outlet Id of a container IB (for example, a bottle) that contains ink to be supplied and the liquid inlet 150, the ink is supplied from the container IB to the tank 100.

Note that, as shown in FIG. 5, in the state in which the introduction outlet Id of the container IB and the liquid inlet 150 are connected and ink is supplied, the printer 10 of the present embodiment is configured such that there is no portion that interferes with the container IB above the container IB. In other words, when the container IB is attached to and detached from the printer 10, the container IB is not interfered with at all. Specifically, although the operation unit 20 protrudes in the +Y direction from the scanner body 16, the operation unit 20 is not provided above the container IB (above the tank 100). With this configuration, a user can easily handle the container IB, and thus convenience can be enhanced.

After the ink has been supplied from the container IB to the tank 100, the container IB is detached from the tank 100, and the plug member 40 is shifted to the closed state as shown in FIG. 3A. Note that, at that time, it is preferable that fingers are brought into contact with the top portion 42*a* (see FIG. 3B) of the plug main body 42 and the plug member 40 is pressed toward the tank 100 side. In this manner, the liquid inlet 150 can be reliably closed with the plug main body 42. After that, the cover 31 is shifted to the closed state (see FIG. 1).

Thus, the supply of ink to the tank 100 in the printer 10 is completed.

Note that in the present embodiment, a mode in which one tank 100 is mounted in the printer 10 has been described, but the invention is not limited thereto. For example, a mode in which multiple tanks 100 are mounted in the printer 10 may be used. Specifically, the tanks 100 may be mounted in which each tank 100 contains ink of different color (black, cyan, magenta, and yellow).

Next, the internal configuration of the printer 10 will be described.

Figure 6:
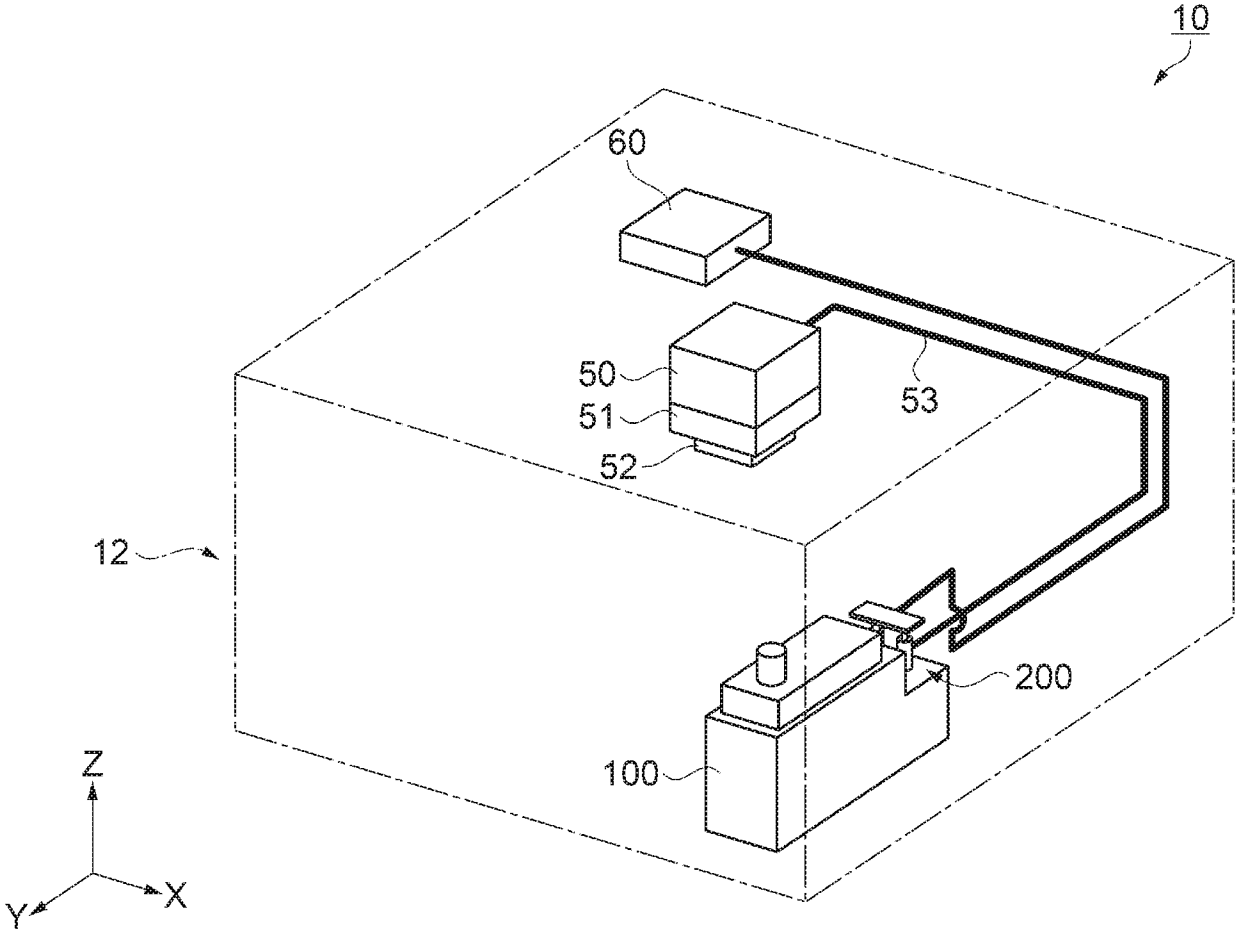
FIG. 6 is a schematic view showing the configuration of the printer (the liquid ejection device).

FIG. 6 is a schematic view showing the internal configuration of the liquid ejection device (printer).

As shown in FIG. 6, the printer 10 includes the tank 100 serving as a liquid tank, a carriage 51, a relay unit 50, a printing head 52 (liquid ejection unit), tubes 53, and so on.

The casing 12 contains the tank 100, the carriage 51, the relay unit 50, the printing head 52, and the tubes 53.

The printer 10 also includes a conveyance mechanism (not shown) for causing the carriage 51 to reciprocate (scan), a conveyance mechanism (not shown) for conveying printing paper, and the like.

The tank 100 contains ink. The tank 100 is connected to the relay unit 50 via the tube 53, and supplies ink to the relay unit 50. The detailed configuration of the tank 100 will be described later. Note that the tubes 53 are respectively made of a tube made of a flexible material such as synthetic rubber.

The carriage 51 is configured to reciprocate along the X direction inside the casing 12. The relay unit 50 and the printing head 52 are mounted in the carriage 51. With a conveyance mechanism (not shown), the carriage 51 reciprocates along the X direction. Accordingly, the scanning direction of the carriage 51 and the printing head 52 is parallel to the X direction.

The printing head 52 is arranged such that ink can be ejected vertically downward on the vertically lower side of the carriage 51. The printing head 52 has a number of nozzles (not shown), and forms an image or the like on a medium such as printing paper by ejecting ink at the time of reciprocation of the carriage 51. The printing paper on which the image or the like is formed is discharged to the medium receiving tray 22 side (see FIG. 1).

The relay unit 50 is connected to the tank 100 via the tube 53. Also, the relay unit 50 is connected to the printing head 52. The relay unit 50 temporarily stores ink that is supplied from the tank 100, and supplies the ink to the printing head 52 in accordance with ejection of the ink from the printing head 52.

Also, the printer 10 includes a controller 60 that controls the timing and amount of ink ejected, the conveyance amount of printing paper, and the like. For example, the controller 60 is constituted by using a microcomputer that includes a central processing unit and a main storage device. The controller 60 implements various functions by the central processing unit to read various programs stored in an external storage device, a recording medium, or the like to the main storage device and executing these programs. In the present embodiment, the controller 60 serves as a printing processing unit that implements, based on printing data that is input to the controller 60 from outside the printer 10, printing processing by controlling the conveyance mechanism of the carriage 51, the printing head 52, the conveyance mechanism for conveying printing paper, and so on. In the printing processing, a printing image is formed on the printing surface of the printing paper by conveying the printing paper and ejecting ink droplets while reciprocating the printing head 52 in the X direction (main scanning direction).

Also, in the tank 100 of the present embodiment, an electrode member 200 (details thereof will be described later) that can detect ink in the tank 100 is provided. The electrode member 200 is connected to the controller 60. The controller 60 also serves as an ink remaining amount management unit for managing the ink remaining amount in the tank 100. Specifically, based on the change of the resistance that is detected by the electrode member 200, the controller 60 detects whether ink of a predetermined remaining amount or more is stored in the tank 100. Then, if the controller 60 detects an insufficient state of the ink amount in which the ink remaining amount is smaller than the predetermined remaining amount in the tank 100, for example, the control unit 60 executes notification processing for notifying the user that it is time to replenish the ink, and prompts the user to refill the ink. Also, after the insufficient state of the ink amount is detected, the controller 60 starts measuring the ejection amount of ink that is ejected by the printing head 52. Then, when that ejected amount reaches a predetermined ejection amount, the controller 60 determines that the remaining amount of the ink in the tank 100 is in the state of ink exhaustion, which is the minimum amount that may cause issues in the printing processing. If it is determined that the remaining amount of the ink in the tank 100 is in the state of ink exhaustion, the controller 60 interrupts the printing processing and informs the user of the state. Note that the predetermined remaining amount for detecting the insufficient state of the ink and the remaining amount for determining the ink exhaustion state may be the same value.

Next, the configuration of the tank 100 will be described.

Figure 7:
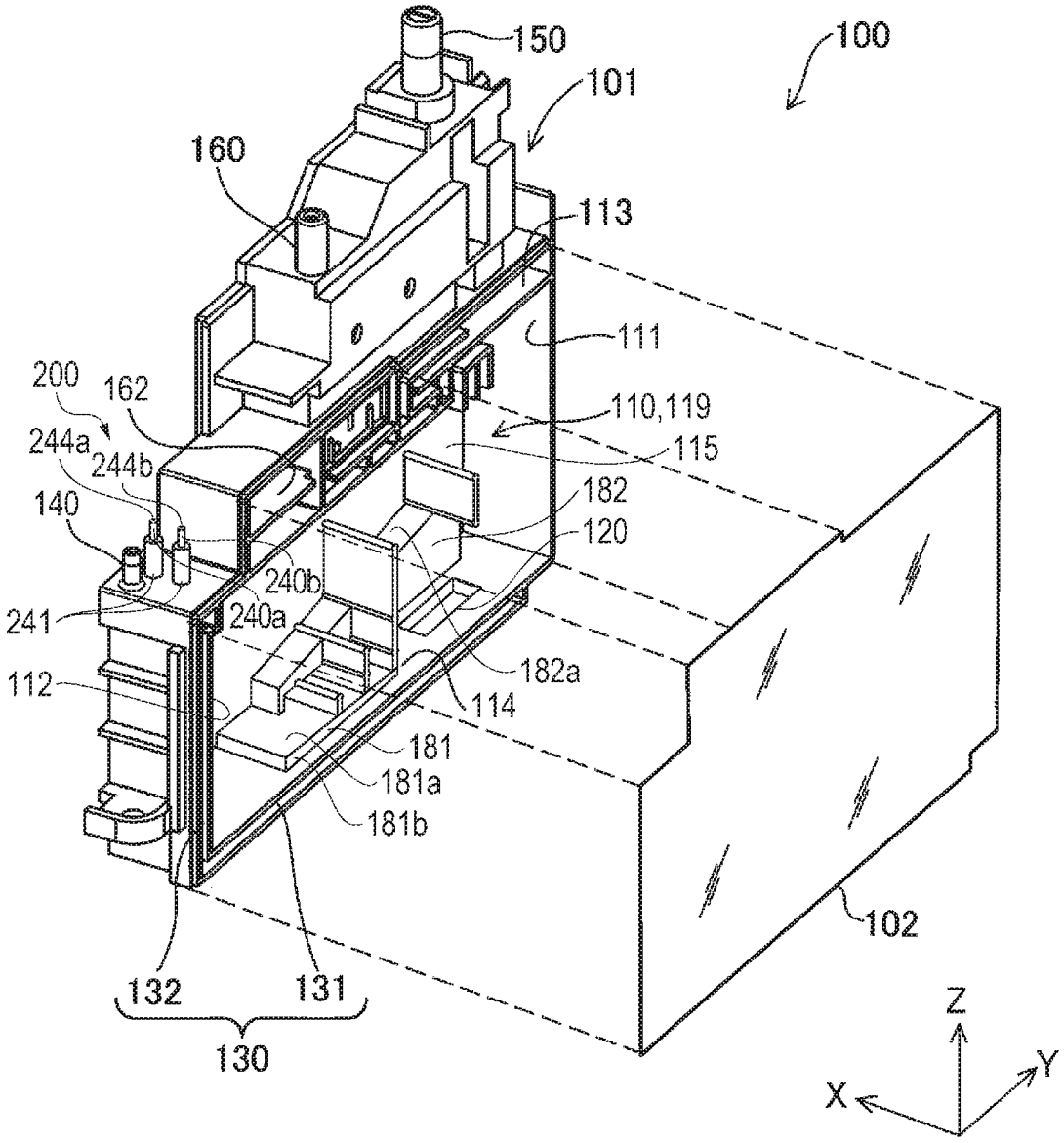
FIG. 7 is a first perspective view showing the configuration of a tank (a liquid tank).
Figure 8:
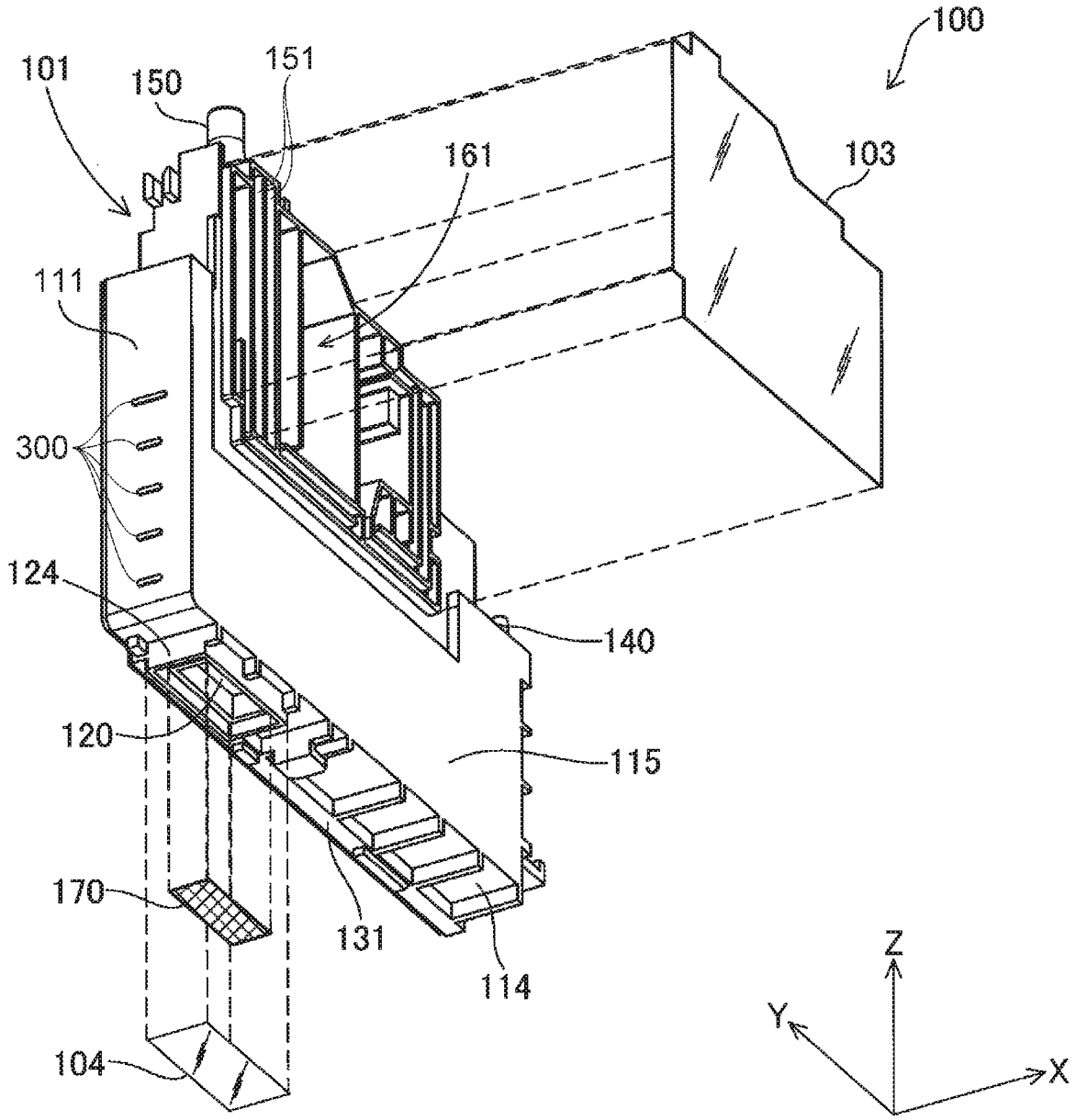
FIG. 8 is a second perspective view showing the configuration of the tank (the liquid tank).
Figure 9:
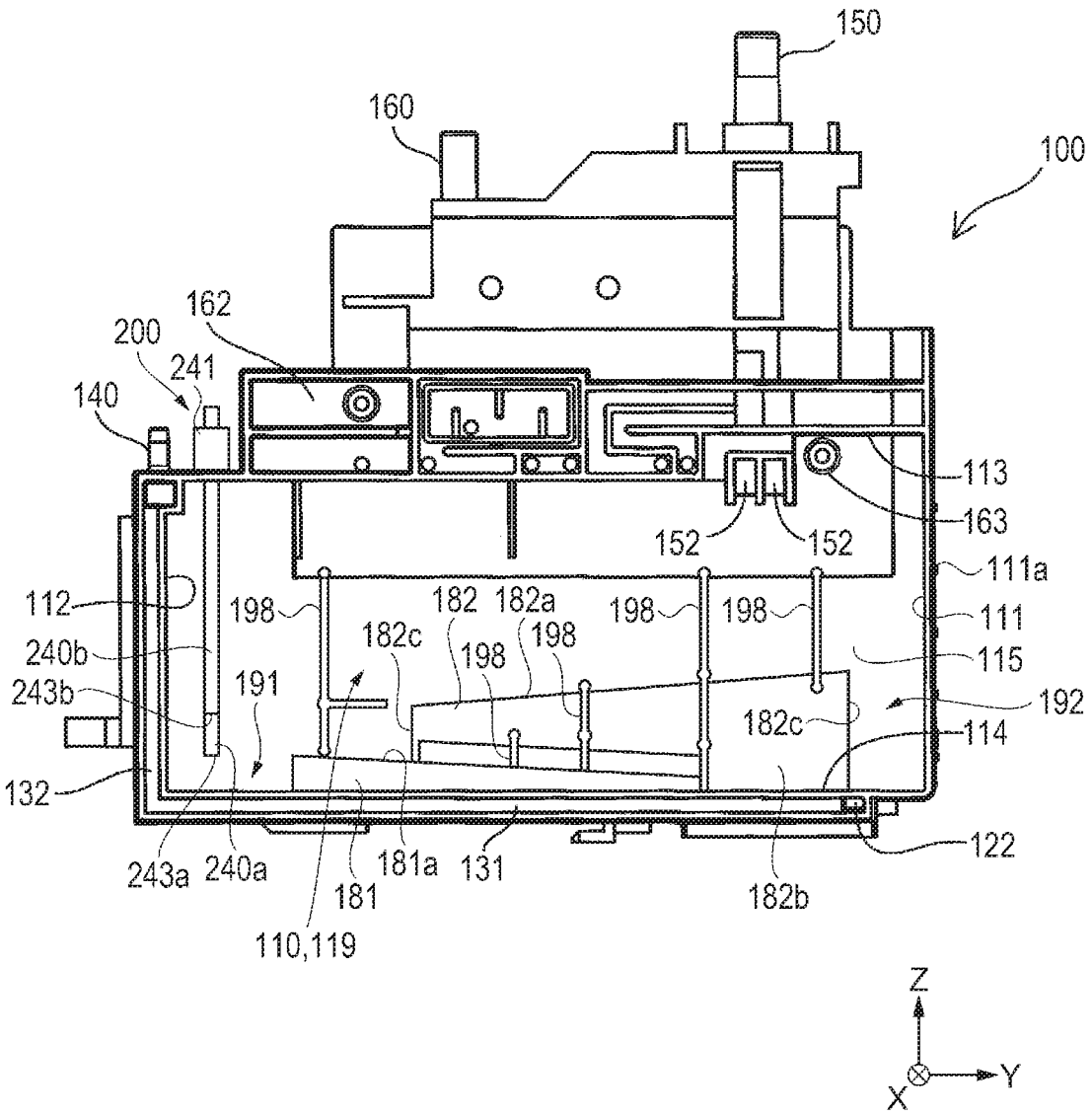
FIG. 9 is a first side view showing the configuration of the tank (the liquid tank).
Figure 10:
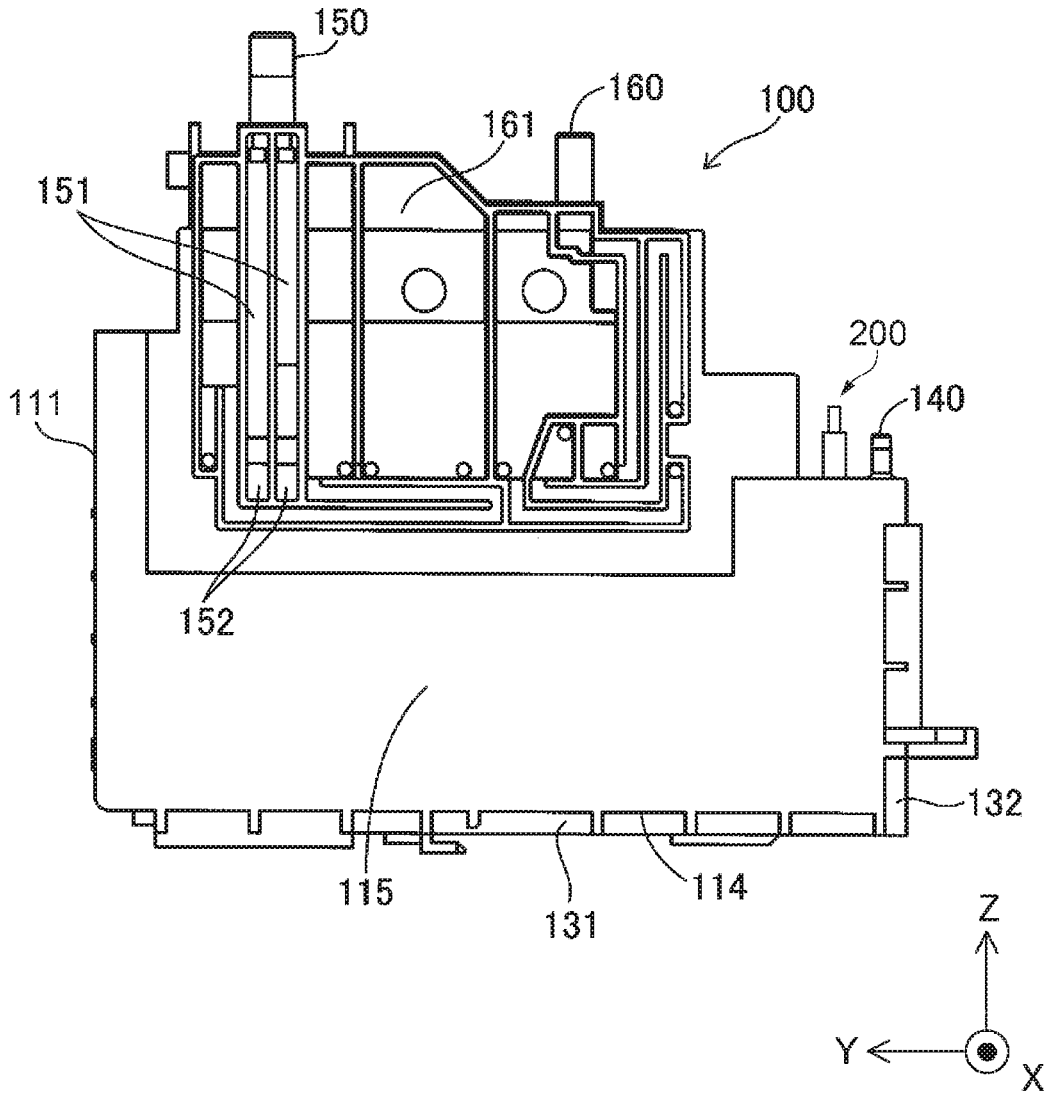
FIG. 10 is a second side view showing the configuration of the tank (the liquid tank).
Figure 11:
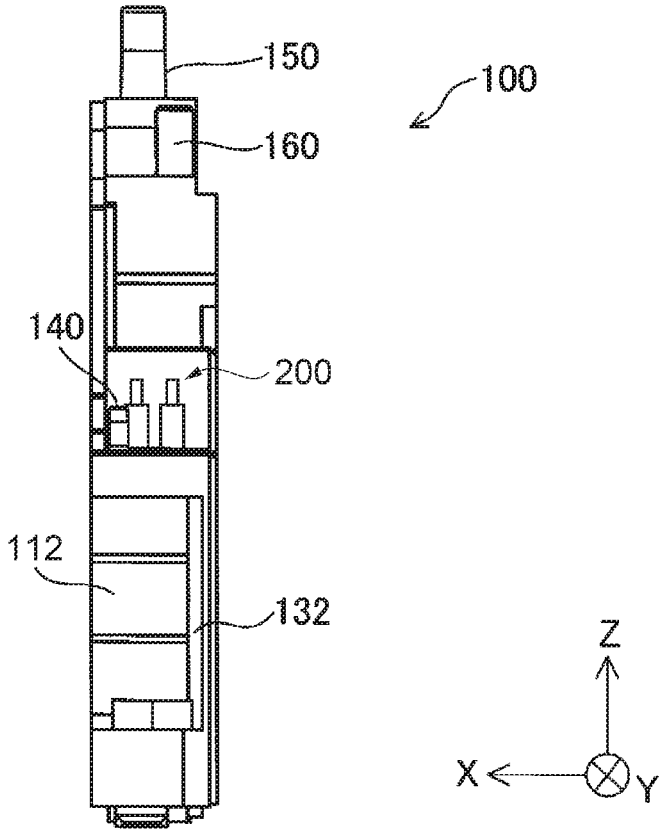
FIG. 11 is a rear side elevation view showing the configuration of the tank (the liquid tank).
Figure 12:
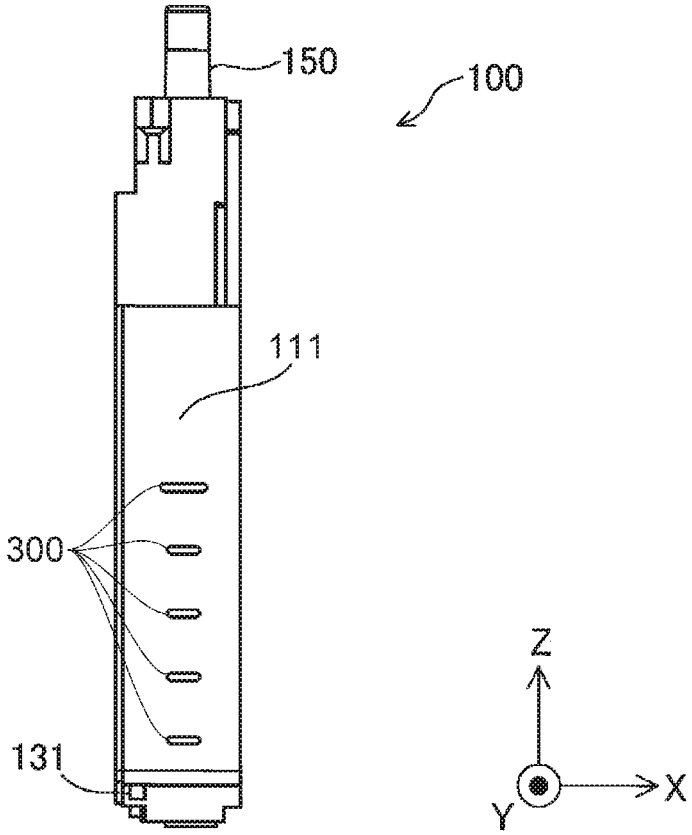
FIG. 12 is an elevation view showing the configuration of the tank (the liquid tank).
Figure 13:
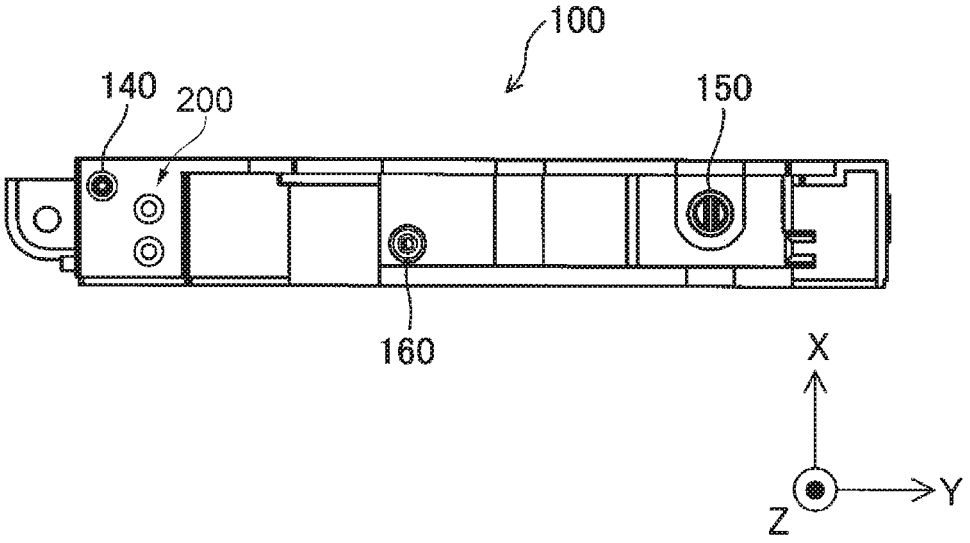
FIG. 13 is a top view showing the configuration of the tank (the liquid tank).
Figure 14:
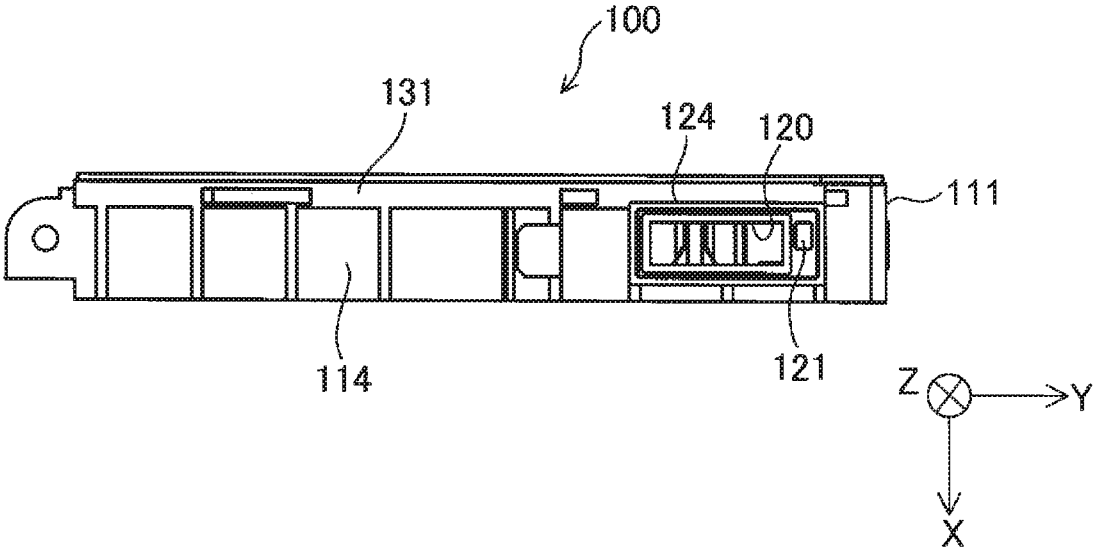
FIG. 14 is a bottom view showing the configuration of the tank (the liquid tank).

FIG. 7 is a first perspective view showing the configuration of the tank, and FIG. 8 is a second perspective view showing the configuration of the tank. FIG. 9 is a first side view showing the configuration of the tank, and FIG. 10 is a second side view showing the configuration of the tank. FIG. 11 is a rear side elevation view showing the configuration of the tank, and FIG. 12 is an elevation view showing the configuration of the tank. FIG. 13 is a top view showing the configuration of the tank, and FIG. 14 is a bottom view showing the configuration of the tank.

Note that, the use state of the tank 10 according to the present embodiment is, as shown in FIG. 1, a state in which the tank 100 is accommodated in the printer 10 in a state where the printer 10 is installed on the X-Y plane (horizontal plane). The surface located on the +Y direction side corresponds to the front of the tank 100. Also, in this state, the surface located on the −Y direction side corresponds to the rear of the tank 100.

As shown in FIGS. 7 and 8, the tank 100 includes a case 101, a first sheet member 102, a second sheet member 103, a third sheet member 104, and a filter 170. Furthermore, the tank 100 includes the electrode member 200.

The case 101 is made of a synthetic resin such as nylon or polypropylene. The case 101 includes the liquid inlet 150, an air introduction inlet 160, and a liquid supply port 140. The case 101 includes an opening portion that is exposed in the −X direction as shown in FIG. 7, and includes opening portions that are respectively exposed in the +X direction and −Z direction as shown in FIG. 8. Inside these opening portions, a number of grooves and rib-like structures are formed. The first sheet member 102, the second sheet member 103, and the third sheet member 104 are arranged so as to cover these opening portions, the edge parts of the first to third sheet members 102 to 104 are welded to the edge parts of the opening portions, and this welding allows various chambers and paths to be formed inside the tank 100. Specifically, the tank 100 has a liquid containing chamber 110, a gas-liquid replacement flow passage 151, a first air communication portion 161, a second air communication portion 162, and a liquid communication path 130. The sheet members 102, 103, and 104 are films that are made of synthetic resin and have flexibility. As the synthetic resin, nylon or polypropylene may also be adopted, for example.

The liquid containing chamber 110 contains ink. As shown in FIG. 7, the liquid containing chamber 110 is constituted by an exterior wall 119 and the first sheet member 102. As shown in FIGS. 7 to 14, the exterior wall 119 includes an upper wall 113, a bottom wall 114, a first side wall 111, a second side wall 112, and a third side wall 115.

Also, in the liquid containing chamber 110, multiple rib portions 198 that protrude in the −X direction from the third side wall 115 are provided. A gap is provided between each of the rib portions 198. In addition, the position of the end portion in the −X direction of each rib portion 198 and the position of the end portion in the −X direction of the exterior wall 119 are aligned. Accordingly, the liquid containing chamber 110 is formed by the end portion in the −X direction of the exterior wall 119 and the end portion in the −X direction of each rib portions 198 being welded to the first sheet member 102.

Also, as shown in FIGS. 7 to 12, in the use state, the upper wall 113 is located in the end portion in the +Z direction of the exterior wall 119. The second air communication portion 162 is arranged above a part of the upper wall 113.

As shown in FIGS. 8 to 10, in the use state, the bottom wall 114 is located in the end portion in the −Z direction of the exterior wall 119. Accordingly, the upper wall 113 and the bottom wall 114 are arranged at positions facing each other with the ink in the liquid containing chamber 110 interposed therebetween. The liquid communication path 130 (a first liquid communication path 131 to be described later) is arranged below (in the −Z direction) a portion closer to the end portion in the −X direction of the bottom wall portion 114, and thus the portion of the bottom wall 114 is not exposed to the outside.

As shown in FIG. 14, a liquid outlet 120 (liquid discharge port) is formed in the bottom wall 114. The liquid outlet 120 is a through hole formed in the thickness direction (the Z axis direction) of the bottom wall 114. The liquid outlet 120 is a rectangle in plan view. The ink in the liquid containing chamber 110 flows out (discharges) from the liquid outlet 120.

Figure 15:
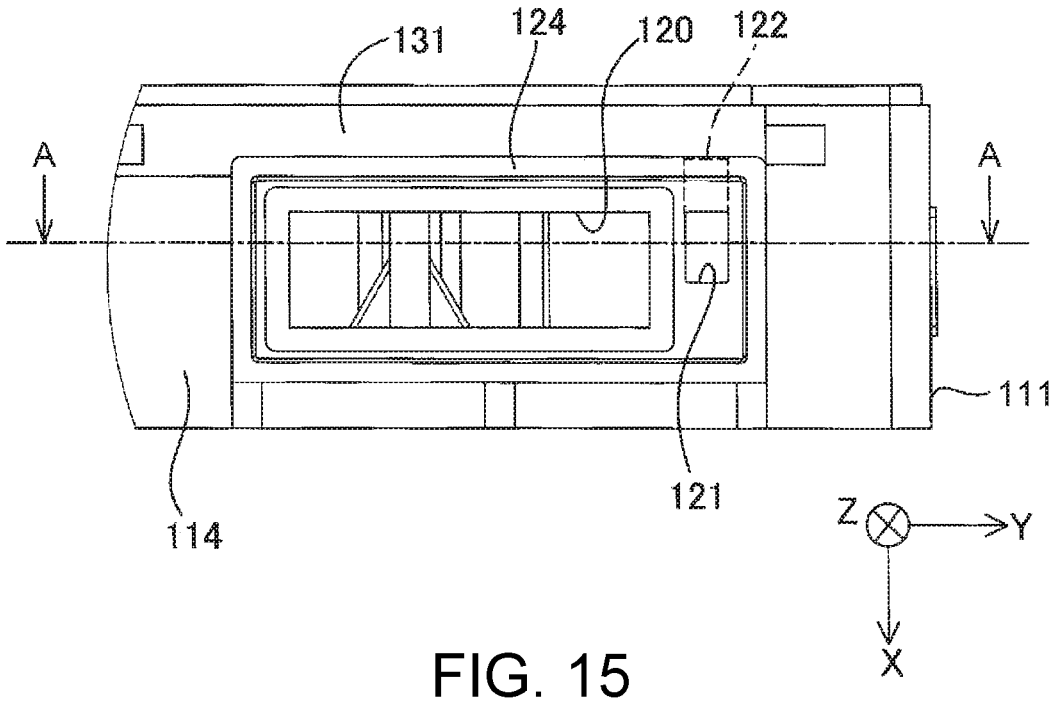
FIG. 15 is a partial enlarged view showing the configuration of the tank (the liquid tank).

FIG. 15 is an enlarged explanatory drawing illustrating a region around the liquid outlet 120 in the bottom wall 114. As shown in FIGS. 14 and 15, an opening 121 is formed in the +Y direction with respect to the liquid outlet 120. The opening 121 communicates with the liquid communication path 130 (an opening 122 of the first liquid communication path 131 described later).

As shown in FIG. 8, the filter 170 is arranged so as to cover the liquid outlet 120 from the −Z direction. The filter 170 removes foreign matter from ink flowing out from the liquid outlet 120. A protruding portion 124 is formed to encompass the liquid outlet 120 and protrude in the −Z direction. The third sheet member 104 has substantially the same shape as the protruding portion 124 in plan view. The third sheet member 104 is formed to cover the protruding portion 124 from the −Z direction and welded to the edge portion of the protruding portion 124 in the −Z direction. This welding can reduce outside leakage of ink flowing from the liquid outlet 120 and passing through the filter 170.

As shown in FIGS. 7 and 9, the second side wall 112 intersects with each of the upper wall 113 and the bottom wall 114. In the use state, the second side wall 112 is located at the end portion of the exterior wall 119 on the rear side (in the −Y direction). In the present embodiment, when two walls "intersect" with each other, this means that the end portions of the two walls contact with each other and that virtually extended walls of these two walls intersect with each other. On the rear side (in the −Y direction) of a part closer to the end portion of the second side wall 112 in the −X direction, the liquid communication path 130 (a second liquid communication path 132 described later) is arranged, and thus this part of the second side wall 112 is not exposed to the outside.

As shown in FIGS. 7 to 9, in the use state, the first side wall 111 is located at the end portion of the exterior wall 119 on the front side (in the +Y direction), and thus is exposed to the outside. Similar to the second side wall 112, the first side wall 111 intersects with each of the upper wall 113 and the bottom wall 114. The first side wall 111 and the second side wall 112 are arranged at positions facing each other with ink in the liquid containing chamber 110 interposed therebetween. As can be seen from FIG. 6, in the present embodiment, the first side wall 111 is located farther from the printing head 52 than the second side wall 112 is in the use state.

The liquid inlet 150 is used for injecting (supplying) ink into the liquid containing chamber 110. As shown in FIGS. 7 to 9, the liquid inlet 150 protrudes in the +Z direction at the end portion of the tank 100 in the +Z direction on the front side (in the +Y direction). For example, when the amount of ink in the tank 100 decreases, a user can inject (refill) the liquid containing chamber 110 by connecting an ink-filled container IB to the liquid inlet 150 (see FIG. 5). As shown in FIG. 10, the liquid inlet 150 communicates with the gas-liquid replacement flow passage 151. The gas-liquid replacement flow passage 151 replaces gas in the liquid containing chamber 110 with ink injected from the liquid inlet 150. The gas-liquid replacement flow passage 151 has two flow passages extending in the Z axis direction. The end portion in the +Z direction of the gas-liquid replacement flow passage 151 communicates with the liquid inlet 150, and the end portion in the −Z direction of the gas-liquid replacement flow passage 151 communicates with an opening 152 formed in the liquid containing chamber 110. When ink is injected from the liquid inlet 150 into the liquid containing chamber 110, one of the two flow passages of the gas-liquid replacement flow passage 151 leads the ink into the liquid containing chamber 110, and the other flow passage discharges gas in the liquid containing chamber 110 to the outside (to the container IB (see FIG. 5)). When ink refilling progresses and then the liquid surface of the ink covers the opening 152, further refilling cannot be performed anymore, because gas in the liquid containing chamber 110 cannot be replaced with ink.

The air introduction inlet 160 is used for introducing air into the liquid containing chamber 110. As shown in FIGS. 7 and 9, the air introduction inlet 160 protrudes in the +Z direction at the end portion of the tank 100 in the +Z direction and is positioned nearly in the center of the tank 100 in the Y axis direction.

As shown in FIGS. 8 and 10, the first air communication portion 161 is configured with the opening portion exposed in the +X direction of the case 101, and the second sheet member 103. As shown in FIGS. 7 and 9, the second air communication portion 162 is configured with the opening portion exposed in the −X direction of the case 101, and the first sheet member 102. As shown in FIGS. 9 and 10, the case 101 includes multiple through holes formed in the thickness direction (the X axis direction) to allow the first air communication portion 161 and the second air communication portion 162 to communicate with each other. In addition, the case 101 includes a through hole 163 in the thickness direction to allow the first air communication portion 161 and the liquid containing chamber 110 to communicate each other. Accordingly, air introduced from the air introduction inlet 160 is supplied into the liquid containing chamber 110 via the first air communication portion 161, the second air communication portion 162, the multiple through holes, and the through hole 163. In the present embodiment, a path for introducing air that includes the air introduction inlet 160, the first air communication portion 161, the second air communication portion 162, the multiple through holes, and the through hole 163 is also referred to as the "air introduction path". Each of the first air communication portion 161 and the second air communication portion 162 has flow passages bending upward, downward, forward, and backward intricately in the use state, and also has a chamber for temporarily storing ink. When ink in the liquid containing chamber 110 flows from the through hole 163 to the air introduction path, this chamber temporarily stores this inflow ink and prevents this inflow ink from flowing to the outside of the tank 100.

The liquid supply port 140 corresponds to an outlet of ink flowing from the tank 100 to the outside. The liquid supply port 140 is inserted into the tube 53 and supplies ink in the liquid containing chamber 110 to the tube 53. As shown in FIG. 9, the liquid supply port 140 protrudes in the +Z direction at the end portion of the tank 100 in the +Z direction on the rear side (in the −Y direction). The liquid supply port 140 communicates with one end of the liquid communication path 130.

The liquid communication path 130 allows the ink from the liquid outlet 120 to pass through the liquid communication path 130. As shown in FIGS. 7 and 9, the liquid communication path 130 includes the first liquid communication path 131 and the second liquid communication path 132.

As shown in FIGS. 7 and 9, the first liquid communication path 131 is provided on the outer surface side (in the −Z direction) of the bottom wall 114. To be more specific, as shown in FIG. 14, the first liquid communication path 131 is formed along the Y axis direction at the end portion in the −X direction of the bottom wall 114. As shown in FIG. 9, the opening 122 is provided at the end portion in the +Y direction of the first liquid communication path 131. As shown in FIG. 15, the opening 122 communicates with the above-mentioned opening 121 provided near the liquid outlet 120.

Figure 16:
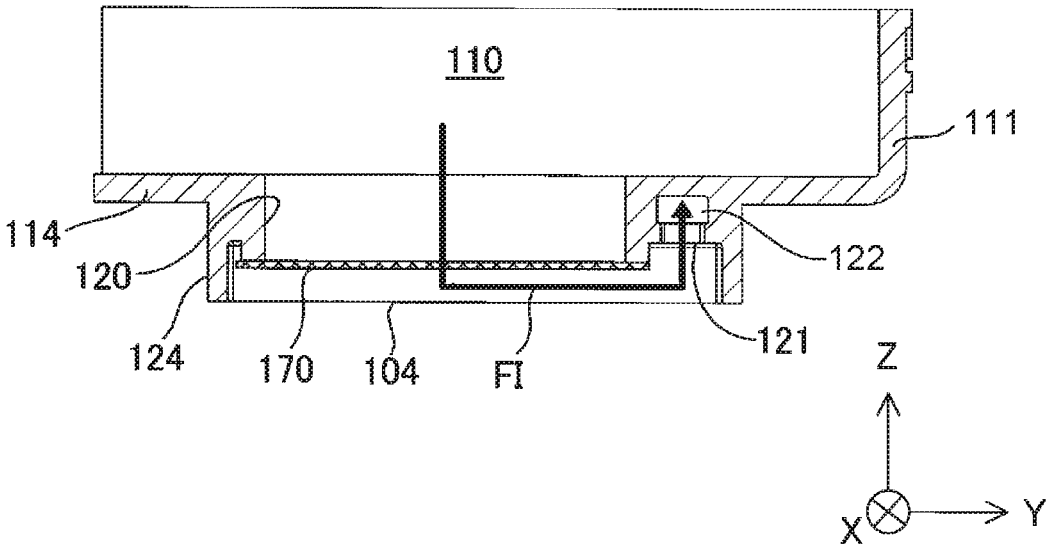
FIG. 16 is a partial cross sectional view showing the configuration of the tank (the liquid tank).

FIG. 16 is a cross-sectional view taken along line A-A of FIG. 15. In FIG. 16, a part of an ink flow FI from the liquid containing chamber 110 is indicated by a thick arrow. The ink in the liquid containing chamber 110 flows from the liquid outlet 120 to pass through the filter 170. Then, the ink passes through a region enclosed with the protruding portion 124 and the third sheet member 104 to reach the opening 121. As mentioned above, the opening 121 communicates with the opening 122, and thus the ink flowing into the opening 121 flows from the opening 122 to the first liquid communication path 131. Note that the ink flow passage from the liquid outlet 120 to the opening 122 is a part of the first liquid communication path 131.

As shown in FIGS. 7 and 9, the end portion in the −Y direction of the first liquid communication path 131 communicates with the end portion in the −Z direction of the second liquid communication path 132. The second liquid communication path 132 is provided on the outer surface side (in the −Y direction) of the second side wall 112. To be more specific, as shown in FIG. 7, the second liquid communication path 132 is formed along the Z axis direction at the end portion in the −X direction of the second side wall 112. As shown in FIG. 9, one of the both end portions of the second liquid communication path 132 that does not communicate with the first liquid communication path 131 communicates with the liquid supply port 140. Accordingly, the ink flowing from the liquid outlet 120 to the first liquid communication path 131 passes through the second liquid communication path 132, and is discharged to the liquid supply port 140.

As shown in FIGS. 7 and 9, the first liquid communication path 131 has a groove (hereinafter, also referred to as "first groove") that is provided on the outer surface side of the bottom wall 114, has a depth in the +X direction, and is elongated along the Y direction. Also, the second liquid communication path 132 has a groove (hereinafter, also referred to as "second groove") that is provided on the outer surface side of the second side wall 112, has a depth in the +X direction, and is elongated along the Z axis direction. By the first groove and the second groove being covered with the first sheet member 102, the first liquid communication path 131 and the second liquid communication path 132 are formed. This configuration allows one side of the first liquid communication path 131 and one side of the second liquid communication path 132 to be formed with the first sheet member 102 that is a single member, and thus the manufacturing cost and time of the tank 100 can be reduced. Moreover, the bottom wall 114 in the −Z direction is used as a part of a wall forming the first liquid communication path 131. Furthermore, the second side wall 112 in the −Y direction is used as a part of a wall forming the second liquid communication path 132. Thus, as compared with the case where the bottom wall 114 and the upper wall 113 are formed separately and the first side wall 111 and the second liquid communication path 132 are formed separately, the tank 100 can be reduced in size and manufactured in a shorter time.

At least one end of the electrode member 200 is provided inside the tank 100. The electrode member 200 is used for detecting ink in the tank 100.

Specifically, the electrode member 200 includes a pair of electrode pins 240*a* and 240*b*. Then, as shown in FIGS. 7 and 9, in the tank 100 of the present embodiment, the pair of electrode pins 240*a* and 240*b* are accommodated in the liquid containing chamber 110. In the present embodiment, the electrode pins 240*a* and 240*b* are formed of a conductive member such as a metal pin extending in a bar shape. It is preferable that the electrode pins 240*a* and 240*b* are formed of a member that suppresses the formation of an oxide film on the surface thereof due to the adhesion of ink. The electrode pins 240*a* and 240*b* may be made of, for example, stainless steel or carbon.

Two through holes for respectively inserting the electrode pins 240*a* and 240*b* are provided in the upper wall 113. In the present embodiment, the above-mentioned through holes are arranged between the second side wall 112 and the air introduction inlet 160, that is, arranged at a position on the second side wall 112 side with respect to the first side wall portion 111. The first electrode pin 240*a* and the second electrode pin 240*b* are inserted into the respective through holes.

The electrode pins 240*a* and 240*b* of the electrode member 200 extend toward the liquid containing chamber 110 of the tank 100 such that at least a part thereof is located above the bottom wall portion 114 (bottom portion). That is, the pair of electrode pins 240*a* and 240*b* extend along the direction of gravity.

Note that, in the present embodiment, the electrode pins 240*a* and 240*b* extend from the upper wall 113 toward the bottom wall 114, but the invention is not limited to this configuration. For example, the electrode pins 240*a* and 240*b* may extend from the second side wall 112 or the third side wall 115 toward the bottom wall 114. In this case, the electrode pins 240*a* and 240*b* may be bent and extend toward the bottom wall 114.

Also, cylindrical sealing members 241 are fitted between the inner peripheral surface of each through hole and the first electrode pin 240*a* and the second electrode pin 240*b*, respectively. With this configuration, the fixability of the electrode pins 240*a* and 240*b* with respect to the upper wall 113 is enhanced, and the airtightness of the liquid containing chamber 110 is enhanced.

In the liquid containing chamber 110, the electrode pins 240*a* and 240*b* extend from the upper side to the lower side along the direction of gravity at positions close to each other. The distance between the electrode pins 240*a* and 240*b* may be, for example, approximately 5 to 20 mm.

In the present embodiment, rear end portions 244*a* and 244*b*, which are respectively upper end portions of the electrode pins 240*a* and 240*b*, are located at the same height outside of the liquid containing chamber 110. The first electrode pin 240*a* is longer than the second electrode pin 240*b*. Accordingly, in the liquid containing chamber 110, a tip portion 243*b* of the second electrode pin 240*b* is located higher than a tip portion 243*a* of the first electrode pin 240*a*. Note that, in the present specification, the "same height" means substantially the same height. For example, considering tolerance, it can be interpreted as the same height if the difference is within the range of ±5%.

In the printer 10 (see FIG. 6), the electrode pins 240*a* and 240*b* are connected to the controller 60.

Then, while the printing processing is being executed or paused, the controller 60 periodically applies a voltage to the second electrode pin 240*b* such that an alternating current flows through the ink, and measures the resistance between the first electrode pin 240*a* and the second electrode pin 240*b*. Note that the alternating current flowing to the ink may be generated by connecting the first electrode pin 240*a* to a capacitor and repeating accumulation and discharge of electric energy in the capacitor via the two electrode pins 240*a* and 240*b*. If the electrical conduction between the ink and the second electrode pin 240*b* is interrupted by the ink in the liquid containing chamber 110 being consumed and the liquid surface of the ink lowering to a position lower than the tip portion 243*b* of the second electrode pin 240*b*, the resistance between the two electrode pins 240*a* and 240*b* increases. When the measured resistance increases to a predetermined threshold value or more, the controller 60 detect an insufficient state of the ink amount in which the ink amount in the liquid containing chamber 110 is smaller than a prescribed amount. Note that the controller 60 may detect a change in the resistance that corresponds to a change in the contact area between the electrode pins 240*a* and 240*b* and the ink as a change in the ink amount in the liquid containing chamber 110.

In the present embodiment, the tip portions 243*a* and 243*b* of the electrode pins 240*a* and the 240*b* are arranged in the lower portion of the liquid containing chamber 110. Accordingly, ink can be detected in the lower part in which it is difficult for a user to visually recognize the ink. Therefore, in the tank 100 according to the present embodiment, there is no scale indicating the lowest limit on scales 300 serving as marks of the remaining amount of the ink in the tank 100.

Specifically, as shown in FIGS. 8 and 12, the first side wall 111 of the tank 100 has a viewing portion 111*a* through which the ink amount of the ink in the tank 100 can be visually recognized. To be more specific, the first side wall 111 is made of a transparent material, and it is possible to visually recognize the ink amount of the ink in the tank 100. Then, in the outer surface of the first side wall 111, as marks of the remaining amount of ink, multiple protruding scales 300 are formed in the Z axis direction. Note that, among the multiple scales 300, the lowermost scale 300 is not a scale indicating the lowest limit of the remaining amount of ink in the tank 100, but indicates the state of the remaining amount of ink in the tank 100. Note that a scale indicating the lowest limit may be separately provided.

Although the printer 10 has been described on the premise that it is used in the state of being installed on the X-Y plane (horizontal plane), there are cases where the printer 10 is used in an inclined state. For example, when the printer 10 is placed on a desk, a table, or the like, a case where a part of the printer 10 is placed on a document or the like placed on the desk, or a case where a placement surface on which the printer 10 on the desk is placed is inclined with respect to a horizontal plane can be considered.

If the printer 10 is used in an inclined state with respect to the horizontal plane, the tank 100 is also inclined. As a result, because the ink in the tank 100 accumulates on the inclined lower side, a relatively large amount of ink remains in the tank 100.

Therefore, the tank 100 according to the present embodiment is configured to reduce the amount of ink remaining in the tank 100 even if the printer 10 is used in an inclined state.

The specific configuration will be described below.

As shown in FIGS. 7 and 9, the tank 100 includes a first protruding portion 181 and a second protruding portion 182 that are provided inside the tank 100 (liquid containing chamber 110), the first protruding member 181 protruding upward in the vertical direction from the bottom portion (bottom wall 114) of the tank 100 in the use state, and the second protruding portion 182 protruding upward in the vertical direction from the bottom portion (bottom wall 114) side to a position higher than the first protruding portion 181.

Similar to the case 100, the first protruding portion 181 and the second protruding portion 182 are integrally formed using a synthetic resin.

Then, letting the direction along the horizontal direction be a first direction (−Y direction), and the direction opposite to the first direction be a second direction (+Y direction), the first protruding portion has, at its upper portion, a first inclined portion 181*a* that is inclined upward in the first direction (−Y direction). The second protruding portion 182 has, at its upper portion, a second inclined portion that is inclined upward in the second direction (+Y direction). In other words, as shown in FIG. 9, the first inclined portion 181*a* of the first protruding portion 181 and the second inclined portion 182*a* of the second protruding portion 182 are alternately inclined in a side view.

The first protruding portion 181 is formed between the end portion in the −Y direction of the liquid outlet 120 and the second side wall 112. In the present embodiment, the end portion in the +Y direction of the first protruding portion 181 is arranged in the vicinity of the end portion in the −Y direction of the liquid outlet 120.

The upper portion of the first inclined portion 181*a* of the first protruding portion 181 has an inclined surface that is gradually inclined upward from the liquid outlet 120 toward the second side wall 112 (toward the −Y direction). Also, the inclined surface is a flat surface. The inclination angle of the inclined surface of the first inclined portion 181*a* is not particularly limited, but it may be set to approximately 3° with respect to the horizontal plane (X-Y plane), for example. This is an inclination angle that is set assuming a case where the tank 100 (printer 10) is inclined upward by approximately 3° in the +Y direction. That is, if the tank 100 is inclined by approximately 3° with respect to the horizontal plane (X-Y plane), the flat surface (inclined surface) of the first inclined portion 181*a* and the horizontal plane are substantially parallel.

Also, a gap is provided between the first protruding portion 181 and the first side wall 111.

The second protruding portion 182 is formed between the end portion in the −Y direction of the first protruding portion 181 and the first side wall 111.

The upper portion of the second inclined portion 182*a* of the second protruding portion 182 has an inclined surface that is gradually inclined upward in the +Y direction. Also, the inclined surface is a flat surface. The inclination angle of the inclined surface of the second inclined portion 182*a* is not particularly limited, but it may be set to approximately 3° with respect to the horizontal plane (X-Y plane), for example. This is an inclination angle that is set assuming a case where the tank 100 (printer 10) is inclined upward by approximately 3° in the −Y direction. That is, if the tank 100 is inclined by approximately 3° with respect to the horizontal plane (X-Y plane), the flat surface (inclined surface) of the second inclined portion 182*a* and the horizontal plane are substantially parallel.

Also, the second inclined portion 182*a* of the second protruding portion 182 is arranged above (in the +Z direction) the first inclined portion 181*a* of the first protruding portion 181.

Also, as shown in FIG. 7, the first protruding portion 181 and the second protruding portion 182 protrude in the −X direction (the third direction) from the third side wall 115. The dimension (length) in the −X direction (the third direction) of the second protruding portion 182 is shorter than the dimension (length) in the −X direction (the third direction) of the first protruding portion 181. Note that the liquid outlet 120 is arranged in the −X direction (the third direction) of the end portion in the +Y direction of the second protruding portion 182.

Also, a gap 192 is provided between the second protruding portion 182 and the first side wall 111. In the present embodiment, the distance between the second protruding portion 182 and the first side wall 111 is a distance of about the length (dimension) in the third direction (the −X direction) of the second side wall 112. By providing the gap 192 between the second protruding portion 182 and the first side wall 111, when a user views the viewing portion 111*a*, the second protruding portion 182 is not seen through the viewing portion 111*a* and the second protruding portion 182 can be made less visible, and thus it is possible to enhance the designability and make it easy to visually recognize the remaining amount of the ink.

Note that the first side wall 111 (the viewing portion 111*a*) is not limited to having a flat surface, and may have a curved surface.

Also, as shown in FIG. 7, the length (dimension) in the third direction (−X direction) of the first protruding portion 181 is shorter than the length (dimension) in the third direction (the −X direction) of the second side wall 112.

That is, the end portion 181*b* in the third direction (the −X direction) of the first protruding portion 181 does not come into contact with the first sheet member 102. To be more specific, a gap is formed between the end portion 181*b* of the first protruding portion 181 and the first sheet member 102. The gap serves as a flow passage through which ink can flow. Accordingly, the gap 191 between the first protruding portion 181 and the second side wall 112, and the liquid outlet 120 are not interrupted, and communicate with each other through the gap between the end portion 181*b* of the first protruding portion 181 and the first sheet member 102.

Also, as shown in FIG. 9, in the gap 191 between the first protruding portion 181 and the second side wall 112, the pair of electrode pins 240*a* and 240*b* of the electrode member 200 extend toward the gap 191 so as to be located above the bottom wall 114 (bottom portion).

To be more specific, the electrode pins 240*a* and 240*b* and the first protruding portion 181 are separated by a distance about equal to or larger than the diameters of the electrode pins 240*a* and 240*b*. With this configuration, a certain distance is secured between the electrode pins 240*a* and 240*b* and the first protruding portion 181, and thus the occurrence of a meniscus caused by ink between the electrode pins 240*a* and 240*b* and the first protruding portion 181 can be prevented. Accordingly, a decrease in detection accuracy can be suppressed.

Also, the electrode pins 240*a* and 240*b* and the second side wall 112 are separated by a distance about equal to or larger than the diameters of the electrode pins 240*a* and 240*b*. With this configuration, a certain distance is secured between the electrode pins 240*a* and 240*b* and the second side wall 112, and thus the occurrence of a meniscus caused by ink between the electrode pins 240*a* and 240*b* and the second side wall 112 can be prevented. Accordingly, a decrease in detection accuracy can be suppressed.

Furthermore, the electrode member 200 (the pair of electrode pins 240*a* and 240*b*) are arranged on the second side wall 112 side facing the first side wall 111 that has the viewing portion 111*a*. Accordingly, when a user views the viewing portion 111*a*, the pair of electrode pins 240*a* and 240*b* of the electrode member 200 can be made less visible, and thus it is possible to enhance the designability and make it easy to visually recognize the remaining amount of ink.

Also, in the state where the tank 100 is mounted in the printer 10, the first side wall 111 is arranged at a position farther from the printing head 52 than the second side wall portion 112 is. Then, the liquid outlet 120 is provided in the bottom wall 114 (bottom portion) of the tank 100, and the liquid outlet 120 is arranged at a position closer to the first side wall 111 than to the second side wall 112. Accordingly, for example, even if the printer 10 falls over in a state in which the first side wall 111 side is higher than the second side wall 112 side, the position of the liquid outlet 120 can be made higher than the liquid surface of the ink in the tank 100, and thus the possibility that ink will flow out from the printing head 52 due to the load of the ink can be reduced.

Next, the actions of the tank 100 will be described.

Figure 17:
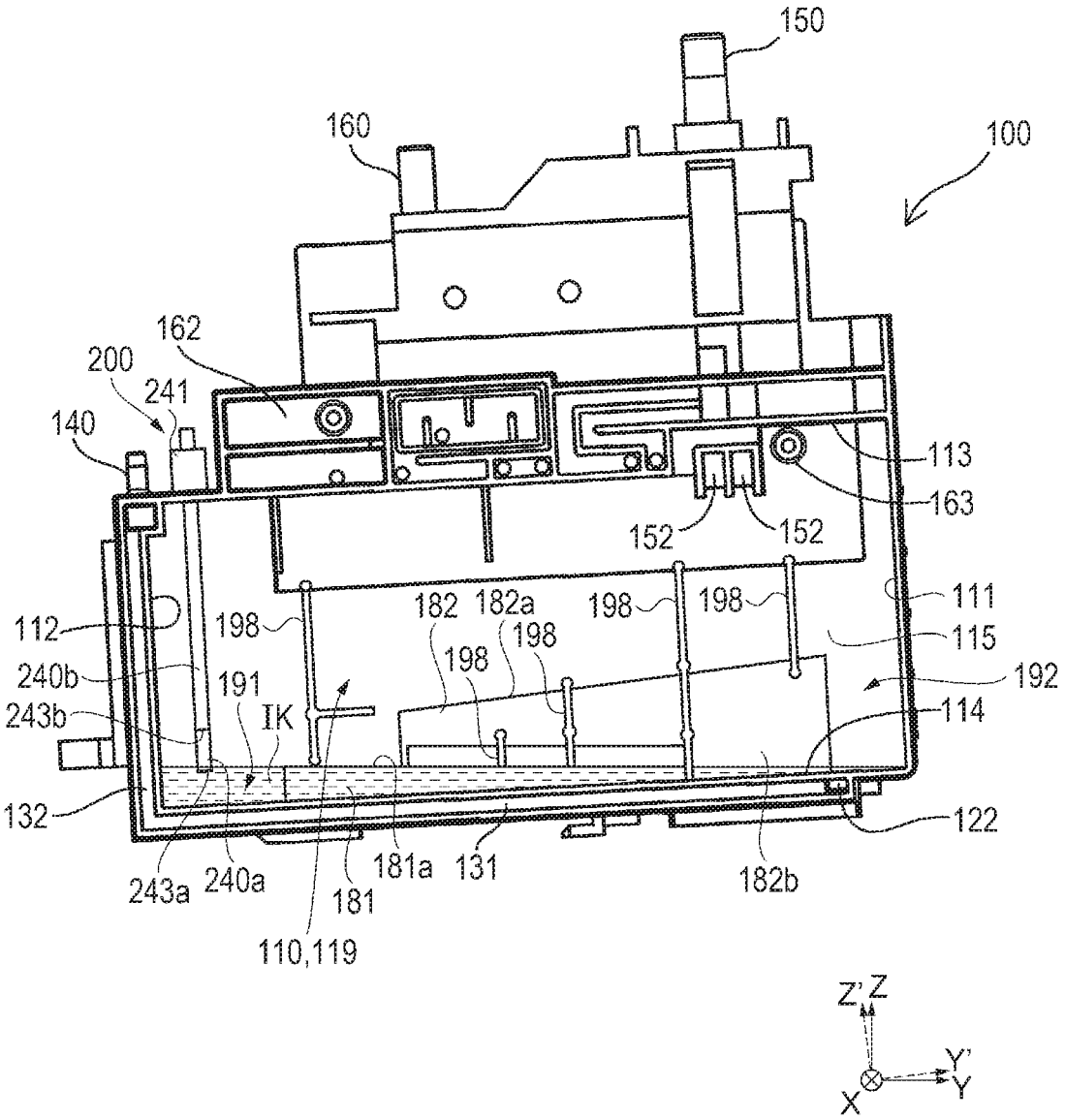
FIG. 17 is an explanatory drawing illustrating the action of the tank (the liquid tank).
Figure 18:
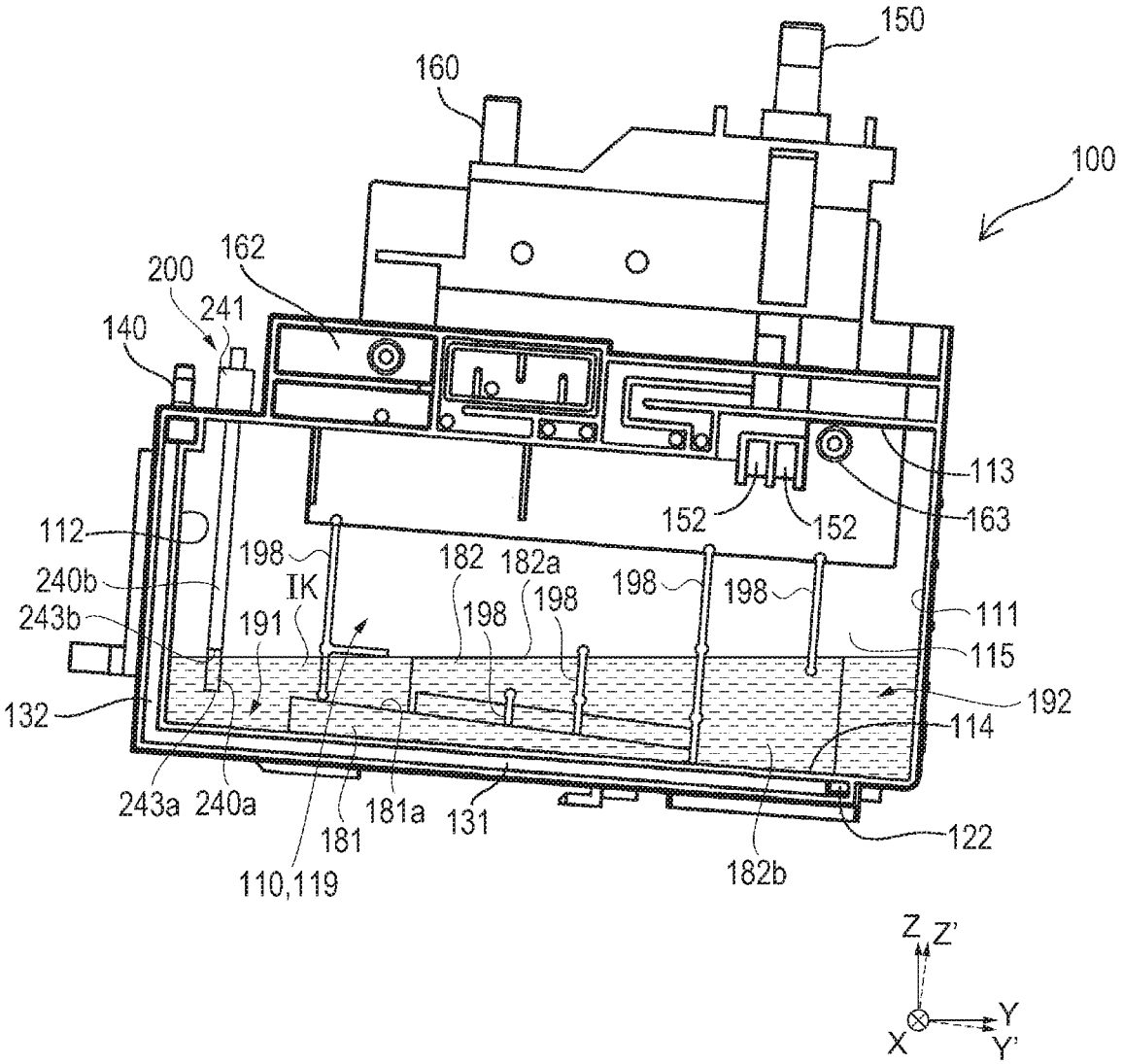
FIG. 18 is an explanatory drawing illustrating the action of the tank (the liquid tank).

FIGS. 17 and 18 are explanatory drawings illustrating the actions of the tank.

First, FIG. 17 shows a case where the bottom wall 114 of the tank 100 (printer 10) is inclined upward in the +Y direction by approximately 3° (for example, the tank 100 (printer 10) is inclined to the first direction side).

As shown in FIG. 17, if the tank 100 is inclined, the ink in the tank 100 will be stored offset toward the second side wall portion 112 side that is the lower side in the tank 100. Here, the first protruding portion 181, which has the first inclined portion 181*a* that is inclined upward in the first direction (−Y direction), is formed in the bottom portion (the bottom wall 114) of the tank 100. For this reason, if the tank 100 is inclined by approximately 3°, the ink in the tank 100 is guided to the liquid outlet 120 along the first inclined portion 181*a*.

In addition, due to the first protruding portion 181 being formed, the volume of the liquid containing chamber 110 is smaller by the volume of the first protruding portion 181, compared with the case where the first protruding portion 181 is not provided in the liquid containing chamber 110 of the tank 100. Accordingly, the ink in the tank 100 can be further guided to the liquid outlet 120 side.

In this case, the ink can flow from the second side wall 112 side to the liquid outlet 120 side through the gap between the end portion 181*b* of the first protruding portion 181 and the first sheet member 102, which serves as the flow passage. As a result, the amount of the ink remaining in the tank 100 can be reduced.

Furthermore, because the gap between the end portion 181*b* of the first protruding portion 181 and the first sheet member 102 also serves as the communication path, for example, even if the attitude of the tank 100 (printer 10) is in a state (use state) placed on the X-Y plane (the horizontal plane), the ink in the tank 100 is not interrupted between the gap 191 and the liquid outlet 120, and thus the ink can flow.

On the other hand, FIG. 18 shows a case where the bottom wall 114 of the tank 100 (printer 10) is inclined upward in the −Y direction by approximately 3° (for example, the tank 100 (printer 10) is inclined to the second direction side (opposite side to the first direction side)).

As shown in FIG. 18, if the tank 100 is inclined, the ink in the tank 100 will be stored offset toward the first side wall portion 111 side that is a lower side in the tank 100.

Here, in the liquid containing chamber 110 of the tank 100, the second protruding portion 182 is formed, which protrudes to a higher position than the first protruding portion 181 in the Z axis direction. With this configuration, the volume of the liquid containing chamber 110 is smaller by the volume of the second protruding portion 182, compared with the case where the second protruding portion 182 is not provided in the liquid containing chamber 110 of the tank 100. Accordingly, the ink in the tank 100 can be further guided to the liquid outlet 120 side.

Also, as shown in FIG. 18, if the tank 100 is inclined, the bulk of the ink increases on the first side wall 111 side, and the bulk of the ink decreases around the electrode member 200. Therefore, the remaining amount of ink in the tank 100 may increase because the detection of the remaining amount of ink by the electrode member 200 is advanced. However, in the present embodiment, because the second protruding portion 182 that protrudes to a position higher than the first protruding portion 181 in the Z axis direction is formed, even if the bulk of the ink increases (even if the ink surface on the first side wall 111 side becomes higher), the ink can be reduced by the volume of the second protruding portion 182.

Note that the heights of the first protruding portion 181 and the second protruding portion 182 may be the same. Even in this case, the same effect as described above can be obtained.

Also, the dimension (length) in the −X direction (the third direction) of the second protruding portion 182 is shorter than the dimension (length) in the −X direction (the third direction) of the first protruding portion 181. Accordingly, a certain volume is secured in the liquid containing chamber 110. That is, for example, as shown in FIG. 5, it is possible to secure the equivalent of the volume of the ink accommodated in one container IB in the liquid containing chamber 110. Consequently, convenience for the user can be improved.

According to the present embodiment, the following effects can be obtained.

Due to the first protruding portion 181 and the second protruding portion 182 being formed, the volume in the liquid containing chamber 110 of the tank is reduced. Accordingly, even if the tank 100 (printer 10) is used in a state where the tank 100 (printer 10) is inclined to either the first direction side or the second direction side, ink equivalent to the volume of the first protruding portion 181 and the second protruding portion 182 can be discharged from the liquid outlet 120, and thus the remaining amount of the ink in the tank 100 can be reduced. With this configuration, a highly convenient tank 100 and the printer 10 can be provided.

The liquid ejection device of the invention is not limited to the tank used in an inkjet printer, and applicable to a tank used in any liquid ejection device that ejects a different kind of liquid other than ink. For example, the invention is applicable to tanks used in various liquid ejection devices as follows.

1. Image recording devices, such as a facsimile device
2. Color material ejection devices used for manufacturing color filters for image display devices, such as a liquid crystal display
3. Electrode material ejection devices used for forming electrodes of organic EL (Electro Luminescence) displays, surface-emitting displays (FED: Field Emission Display), or the like.
4. Liquid ejection devices that discharge liquid containing bioorganic substance used for manufacturing biochips
5. Specimen ejection devices as precision pipettes
6. Lubricant ejection devices
7. Liquid resin ejection devices
8. Liquid ejection devices that eject lubricant to precision machines, such as a watch and a camera, with pinpoint accuracy
9. Liquid ejection devices that eject a transparent liquid resin, such as an ultraviolet curable liquid resin, to form, for example, micro hemispherical lenses (optical lenses) used for elements, such as an optical communication element
10. Liquid ejection devices that eject acid or alkaline etching liquid to etch, for example, substrates
11. Liquid ejection devices that include a liquid ejection head for discharging a very small amount of any other kind of droplet The invention is not limited to the above-mentioned embodiments and thus can be implemented in various configurations without departing from the spirit of the invention. For example, technical features in the embodiments that correspond to technical features in the aspects described in SUMMARY above can be replaced and combined as necessary to solve some or all of the above-mentioned problems or achieve some or all of the above-described advantageous effects. Moreover, technical features not described as being essential in the specification can be omitted as necessary.

This application claims the benefit of foreign priority to Japanese Patent Application No. JP2018-14568, filed Jan. 31, 2018, which is incorporated by reference in its entirety.

What is claimed is:

1. A liquid tank that can supply liquid to a liquid ejection unit of a liquid ejection device, the tank comprising:

an exterior wall that constitutes a liquid containing chamber configured to contain the liquid and includes an upper wall located in an upper part in the vertical direction in a use state, a bottom wall opposed to the upper wall, a first side wall intersecting with each of the upper wall and the bottom wall and having a viewing portion through which the liquid amount of the liquid can be visually recognized, a second side wall opposed to the first side wall, and a third side wall intersecting with each of the upper wall, the bottom wall, the first side wall, and the second side wall;

a liquid discharge port configured to discharge the liquid to the outside of the liquid tank; and a first protruding portion and a second protruding portion that are provided inside the liquid tank and each protrude from the third side wall and the bottom wall, wherein, letting a direction from the first side wall to the second side wall be a first direction, and a direction opposite to the first direction be a second direction, the height of the second protruding portion from the bottom wall in a use state is higher than the height of the first protruding portion from the bottom wall, the first protruding portion includes, at an upper portion thereof, a first inclined portion that is inclined to the upper part in the first direction, and the second protruding portion includes, at an upper portion thereof, a second inclined portion that is inclined to the upper part in the second direction.

2. The liquid tank according to claim 1, further comprising:

an electrode member, at least one end of which is located in the liquid tank and configured to detect the liquid, wherein, a first gap is provided between the first protruding portion and the second side wall, and the electrode member is arranged in the first gap such that the one end is located above the bottom wall when viewed in plan view toward the third side wall.

3. The liquid tank according to claim 2, wherein a second gap is provided between the second protruding portion and the second side wall, and the electrode member is arranged such that the one end is located above the bottom wall and in the second gap when viewed in a plan view toward the third side wall.

4. The liquid tank according to claim 1, wherein letting a direction orthogonal to the first direction in the horizontal direction be a third direction, the length of the first protruding portion in the third direction is shorter than the length of the second side wall in the third direction.

5. The liquid tank according to claim 4, wherein the length of the second protruding portion in the third direction is shorter than the length of the first protruding portion in the third direction.

6. The liquid tank according to claim 1, wherein a gap is provided between the second protruding portion and the first side wall.

7. The liquid tank according to claim 1, wherein a gap is provided between the first protruding portion and the first side wall.

8. The liquid tank according to claim 1, wherein the first side wall is arranged at a position farther from the liquid ejection unit than the second side wall is, and the liquid discharge port is provided in the bottom wall, and is arranged at a position closer to the first side wall than to the second side wall.

9. A liquid ejection device, comprising:

the liquid tank according to claim 1; and the liquid ejection unit.

10. A liquid ejection device, comprising:

the liquid tank according to claim 2; and the liquid ejection unit.

11. A liquid ejection device, comprising:

the liquid tank according to claim 3; and the liquid ejection unit.

12. A liquid ejection device, comprising:

the liquid tank according to claim 4; and the liquid ejection unit.

13. A liquid ejection device, comprising:

the liquid tank according to claim 5; and the liquid ejection unit.

14. A liquid ejection device, comprising:

the liquid tank according to claim 6; and the liquid ejection unit.

15. A liquid ejection device, comprising:

the liquid tank according to claim 7; and the liquid ejection unit.

16. A liquid ejection device, comprising:

the liquid tank according to claim 8; and the liquid ejection unit.

17. The liquid tank of claim 1, wherein the first and second directions extend along a longitudinal axis of the liquid containing chamber.

18. The liquid tank of claim 1, wherein the first protruding portion and the second protruding portion each protrude from the third side wall in a direction substantially perpendicular to the first direction and the second direction.

* * * * *